US006402505B1

(12) United States Patent
Okada et al.

(10) Patent No.: US 6,402,505 B1
(45) Date of Patent: Jun. 11, 2002

(54) COMBUSTION DEVICE

(75) Inventors: Hiroshi Okada, Kariya; Kiyoshi Kawaguchi, Toyota, both of (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 09/506,035

(22) Filed: Feb. 17, 2000

(30) Foreign Application Priority Data

Feb. 19, 1999 (JP) ..... 11-041791
Oct. 29, 1999 (JP) ..... 11-309415

(51) Int. Cl.[7] ..... F23N 1/00; F23C 5/28

(52) U.S. Cl. ..... 431/18; 431/181; 431/186; 431/175; 431/185; 431/350; 431/9; 431/12; 431/40; 239/402.5

(58) Field of Search ..... 431/18, 181, 186, 431/190, 159, 160, 174, 175, 185, 188, 350, 8, 9, 12, 75, 88, 40, 36, 37; 236/9 R; 239/399, 402.5; 60/728, 742, 749; 337/3, 36, 333

(56) References Cited

U.S. PATENT DOCUMENTS 1,651,348 A * 11/1927 Bixby ..... 431/186
3,687,600 A * 8/1972 Gruswitz ..... 431/186
3,813,033 A * 5/1974 Caparone ..... 236/9 R
3,852,022 A * 12/1974 Medeot et al. ..... 431/186
4,396,372 A * 8/1983 Matumoto et al. ..... 431/208
4,547,150 A * 10/1985 Vereecke ..... 431/12
4,588,375 A * 5/1986 Sandstrom ..... 431/186
5,782,626 A * 7/1998 Joos et al. ..... 431/8
6,174,160 B1 * 1/2001 Lee et al. ..... 431/8

FOREIGN PATENT DOCUMENTS

JP 59-13817 A * 1/1984
JP A-5-106806 4/1993
JP A-9-209875 8/1997
WO WO 93/23172 11/1993

* cited by examiner

*Primary Examiner*—Henry Bennett
*Assistant Examiner*—Josiah C. Cocks
(74) *Attorney, Agent, or Firm*—Harness, Dickey & Pierce, PLC

(57) ABSTRACT

In a combustion unit, a fuel collision member is disposed between a fuel injection valve and a combustion chamber. The fuel collision member is positioned so that, a part of fuel injected from said fuel injection valve is introduced into the combustion chamber while colliding with the fuel collision member, and the other part of fuel is directly introduced into the combustion chamber without colliding with the fuel collision member. Thus, fuel introduced into the combustion chamber is atomized while being introduced into the combustion chamber in a wide range.

41 Claims, 17 Drawing Sheets

COMBUSTION DEVICE

CROSS-REFERENCE TO RELATED APPLICATION

This application is related to and claims priority from Japanese Patent Applications No. Hei. 11-41791 filed on Feb. 19, 1999, and No. Hei. 11-309415 filed on Oct. 29, 1999, the contents of which are hereby incorporated by reference.

BACKGROUND OF THE INVENTION

1. Field of the Invention

The present invention relates to a combustion device which is suitably used for a heating unit for heating a passenger compartment of a vehicle or for heating a vehicle component, for example.

2. Description of Related Art

In a conventional combustion device described in JP-A-9-209875, a fuel collision space is provided at a downstream position of an injection nozzle of a fuel injection unit, nozzle holes are provided at positions opposite to the fuel collision space with each other, and fuel injected from the injection nozzle is introduced into the fuel collision space from the nozzle holes to collide with each other in the fuel collision space.

Fuel collided in the collision space is pounded to become a minute-particle atomized state. The atomized fuel spreads from the collision space to a combustion chamber, and thereby improving combustion effect of fuel in the combustion chamber. Because the injection fuel collides with each other in the fuel collision space to be atomized, an ignition time delay during an ignition is prevented.

However, in the conventional combustion device, since the fuel collision space is provided at the downstream side of the injection nozzle, a wall for defining the fuel collision space restricts fuel from flowing from the injection nozzle to the combustion chamber. Therefore, fuel may be not distributed in an entire range in the combustion chamber, and fuel combustion performance during a normal combustion becomes insufficient.

SUMMARY OF THE INVENTION

In view of the foregoing problems, it is an object of the present invention to provide a combustion device in which fuel injected from a fuel injection unit is readily introduced into a combustion chamber in a wide range while being sufficiently atomized.

According to the present invention, a combustion device includes a combustion receiver for defining a combustion chamber, a fuel injection unit having an injection port for injecting fuel to be introduced into the combustion chamber, an air supplying unit for supplying air into the combustion chamber, an ignition unit for igniting a mixed gas between fuel and air in the combustion chamber, and a fuel collision unit disposed between the injection port and the combustion chamber. The position of the fuel collision unit is set so that, a part of fuel injected from the injection port of the fuel injection unit collides with the fuel collision unit, and the other part of fuel is directly introduced from the injection port to the combustion chamber while being prevented from colliding with the collision unit. Thus, a part of fuel introduced into the combustion chamber is atomized by the fuel collision. As a result, even when temperature of the combustion chamber is low (e.g., normal temperature) at an ignition time, because the part of fuel is atomized, mixing performance between fuel and air is improved. Therefore, ignition performance of mixed gas is improved, and an ignition delay time is reduced. On the other hand, because the other part of fuel is directly introduced into the combustion chamber without collision, fuel can be introduced into a wide range of the combustion chamber, and combustion performance in the combustion chamber is improved.

Preferably, when fuel injected from the injection port of the fuel injection unit passes through a fuel opening of a plate portion of the fuel collision unit, a part of fuel is introduced into the combustion chamber while colliding with an edge portion between an inner wall defining the fuel opening and a surface of the plate portion at a side of the combustion chamber, and the other part of fuel is introduced into the combustion chamber through the fuel opening while being prevented from colliding with the edge portion. Therefore, distributing performance of fuel in the combustion chamber is further improved, and the fuel atomization is facilitated using a steering force of the edge portion.

More preferably, the combustion device further includes a detecting unit for detecting a combustion state of mixed gas between fuel from the fuel injection unit and air from the air supplying unit, and a control unit for controlling an operation state of the fuel injection unit in accordance with the combustion state detected by the detecting unit. Further, the fuel injection unit includes an electromagnetic valve for injecting liquid fuel having a pressure higher than a predetermined pressure, and the control unit controls a fuel injection frequency of the electromagnetic valve in accordance with the combustion state detected by the detecting unit. Thus, the fuel atomization is further improved in a case such as the ignition time, and the mixing performance between fuel and air is further improved.

According to the present invention, the control unit controls a fuel-collision switching unit to selectively set a collision mode where fuel injected from the fuel injection unit is introduced into the combustion chamber while colliding with a collision member, and a non-collision mode where fuel injected from the fuel injection unit is introduced into the combustion chamber without colliding with the collision member, in accordance with temperature within the combustion chamber. Thus, even when the temperature of the combustion chamber is low, the fuel atomization is improved. On the other hand, when the temperature of the combustion chamber is high, fuel is introduced into the combustion chamber in a wide range, and fuel distribution performance is improved.

On the other hand, the switching between the collision mode and the non-collision mode is performed in accordance with pressure of air supplying from the air supplying unit. Further, the control unit controls the fuel-collision switching unit to set the collision mode when the pressure of air from the air supplying unit is lower than a predetermined pressure, and the control unit controls the fuel-collision switching unit to set the non-collision mode when the pressure of air from the air supplying unit is higher than the predetermined pressure. Thus, combustion performance of fuel in the combustion chamber is further improved.

BRIEF DESCRIPTION OF THE DRAWINGS

Additional objects and advantages of the present invention will be more readily apparent from the following detailed description of preferred embodiments when taken together with the accompanying drawings, in which.

DETAILED DESCRIPTION OF THE PRESENTLY PREFERRED EMBODIMENTS

Preferred embodiment of the present invention will be described hereinafter with reference to the accompanying drawings.

Figure 1:
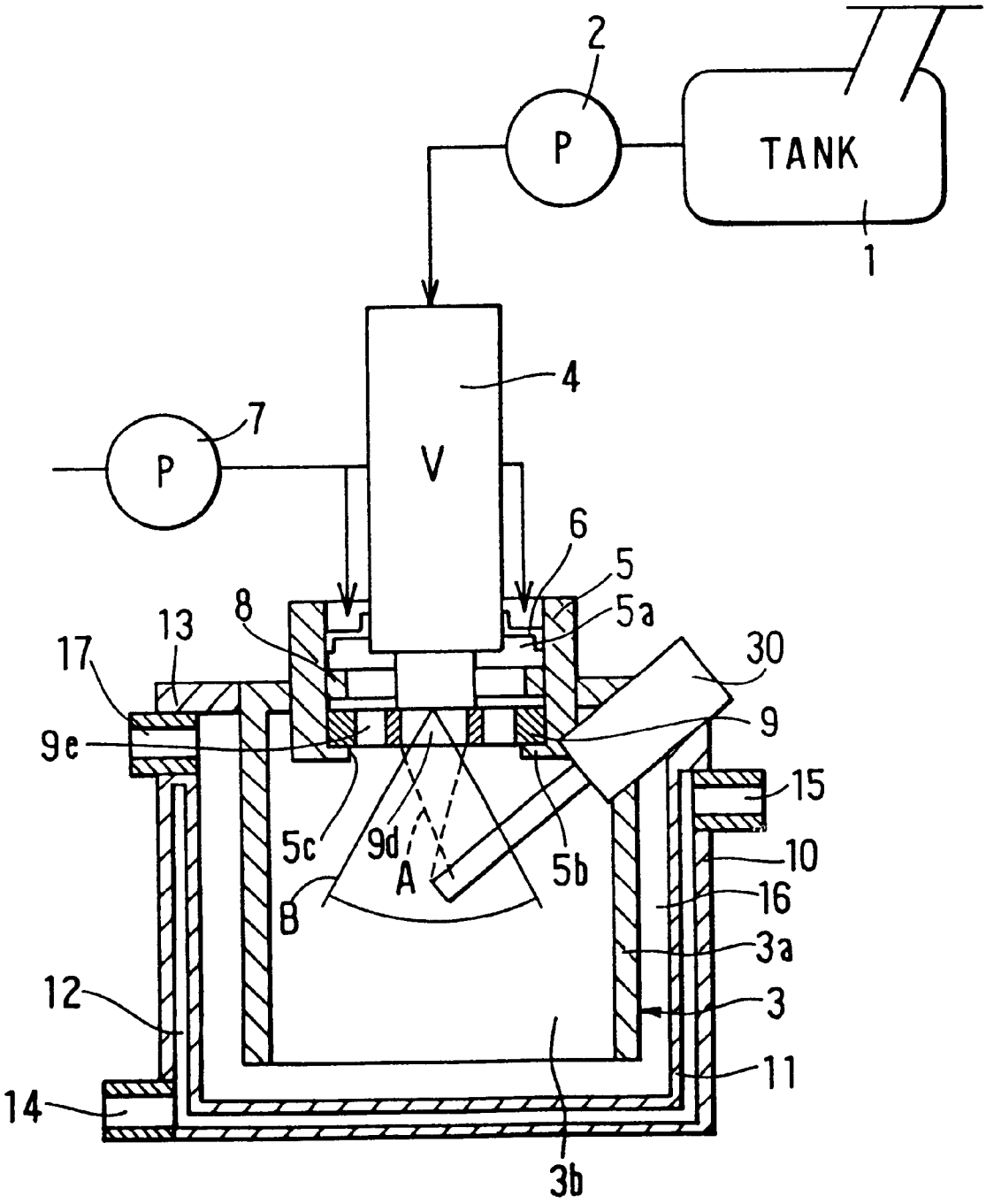
FIG. 1 is a partially vertical sectional view showing a combustion device according to a first preferred embodiment of the present invention.

A first preferred embodiment of the present invention is described with reference to FIGS. 1–6. As shown in FIG. 1, a combustion device includes a fuel tank 1 for storing fuel (e.g., light oil) therein, a fuel pump 2 driven by electrical power for pumping fuel from the fuel tank 1 to a downstream fuel passage, a cylindrical combustion receiver 3, and an electromagnetic fuel injection valve 4 disposed in a cylindrical portion 5. The cylindrical portion 5 is attached to one side end of an outer wall 3*a* of the combustion receiver 3 in an axial direction.

The fuel injection valve 4 is attached into an air introduction port 5*a* inside the cylindrical portion 5 using plural stays 6 so that the fuel injection valve 4 and the cylindrical portion 5 are positioned to have a co-axis. Air for burning fuel is introduced into the air introduction port 5*a* from an air pump 7 driven electrically. In FIG. 1, a pipe structure for connecting the air pump 7 and the air introduction port 5*a* is not indicated. However, actually, the air pump 7 and the air introduction port 5*a* are connected through a connection pipe.

A ring throttle member 8 is disposed in the cylindrical portion 5 to enclose a top end side of the fuel injection valve 4 at an upstream side from a fuel injection position. A fuel collision member 9 is disposed on a circular flange portion 5*b* of the cylindrical portion 5 to be positioned between the fuel injection side of the fuel injection valve 4 and a combustion chamber 3*b* of the combustion receiver 3. For example, the fuel collision member 9 is fixed to the cylindrical portion 5 through a screw (not shown). Further, as shown in FIG. 1, an opening portion 5*c* is formed in the cylindrical portion 5.

Figure 2:
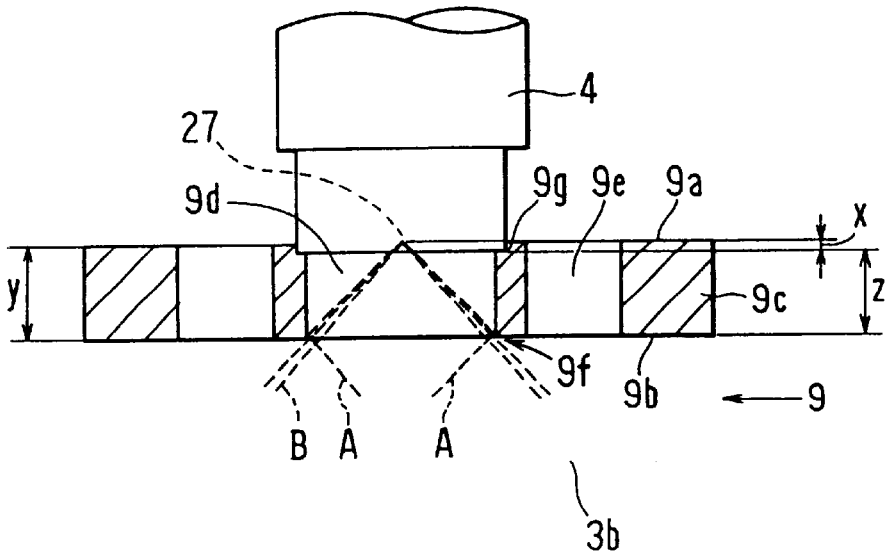
FIG. 2 is an enlarged view showing a fuel collision member of the combustion device in FIG. 1.

FIG. 2 is an enlarged view showing an arrangement position of the fuel collision member 9 relative to the fuel injection valve 4. The fuel collision member 9 includes a plate portion 9*c* having a first surface 9*a* opposite to the fuel injection side of the fuel injection valve 4 and a second surface 9*b* opposite to the combustion chamber 3*b*. In the plate portion 9*c*, a fuel-flowing hole (fuel opening) 9*d* through which fuel flows and plural air-flowing holes (air opening) 9*e* through which air flows are respectively formed. The plural air-flowing holes 9*e* are provided in the plate portion 9 around the fuel-flowing hole 9*d*. The fuel-flowing hole 9*d* of the fuel collision member 9 is provided to correspond to an injection nozzle of the fuel injection valve 4, and the air-flowing hole 9*e* is provided to correspond to the air introduction port 5*a*.

In the first embodiment, four injection ports 27 (see FIG. 6) are provided in the fuel injection valve 4. Further, a diameter of each injection port 27 is set at 0.15 mm, an injection angle $\alpha$ of fuel is set at 66°. Further, a distance shown by "x" in FIG. 2, between a top end of the fuel injection valve 4 and the injection port 27 in the axial direction is set at 0.3 mm. A diameter of the plate portion 9*c* of the fuel collision member 9 is 16 mm, a diameter of the fuel-flowing hole 9*d* is 5 mm, and a distance between the first and second surfaces 9*a*, 9*b* (i.e., thickness "y" of the plate portion 9*c*) is 4.5 mm. Further, the plate portion 9*c* has a step portion 9*g* for supporting the fuel injection valve 4. A wall thickness (i.e., thickness "Z" in FIG. 2) of the plate portion 9*c* at the step portion 9*g* is 3.55 mm.

In a boundary between an inner wall for defining the fuel-flowing hole 9*d* of the fuel collision member 9 and the plate portion 9*c*, edges are formed on the first and second side surfaces 9*a*, 9*b*. In the first embodiment, the combustion device is disposed so that a part of fuel injected from the fuel injection valve 4 collides with an edge portion 9*f* on the second side surface 9*b*.

That is, in the first embodiment, the relative position between the fuel injection valve 4 and the fuel collision member 9 is set in such a manner that, a part of fuel injected from the four injection ports 27 of the fuel injection valve 4 collides with the edge portion 9*f* as shown in FIG. 2, and the other part of fuel injected from the four injection ports 27 of the fuel injection valve 4 is directly introduced into the combustion chamber 3*b* without colliding with the edge portion 9*f*. The fuel injection with the collision operation and the non-collision operation is performed both in an ignition time of the combustion device and in a normal combustion of the combustion device.

As shown in FIG. 1, a water circulation passage 12 is provided between a cylindrical outer housing 10 and a cylindrical inner housing 11 disposed inside the outer housing 10. The housings 10, 11 are fixed to the combustion receiver 3 through a ring flange 13. The water circulation passage 12 communicates with an inlet 14 and an outlet 15 provided in the outer housing 10. For example, the inlet 14 and the outlet 15 are connected to a heater core of a vehicle air conditioner so that water in the water circulation passage 12 is introduced into the heater core.

On the other hand, a combustion gas passage 16 is provided between the combustion receiver 3 and the inner housing 11, and communicates with an exhaust gas outlet 17 provided in the housings 10, 11.

Figure 6:
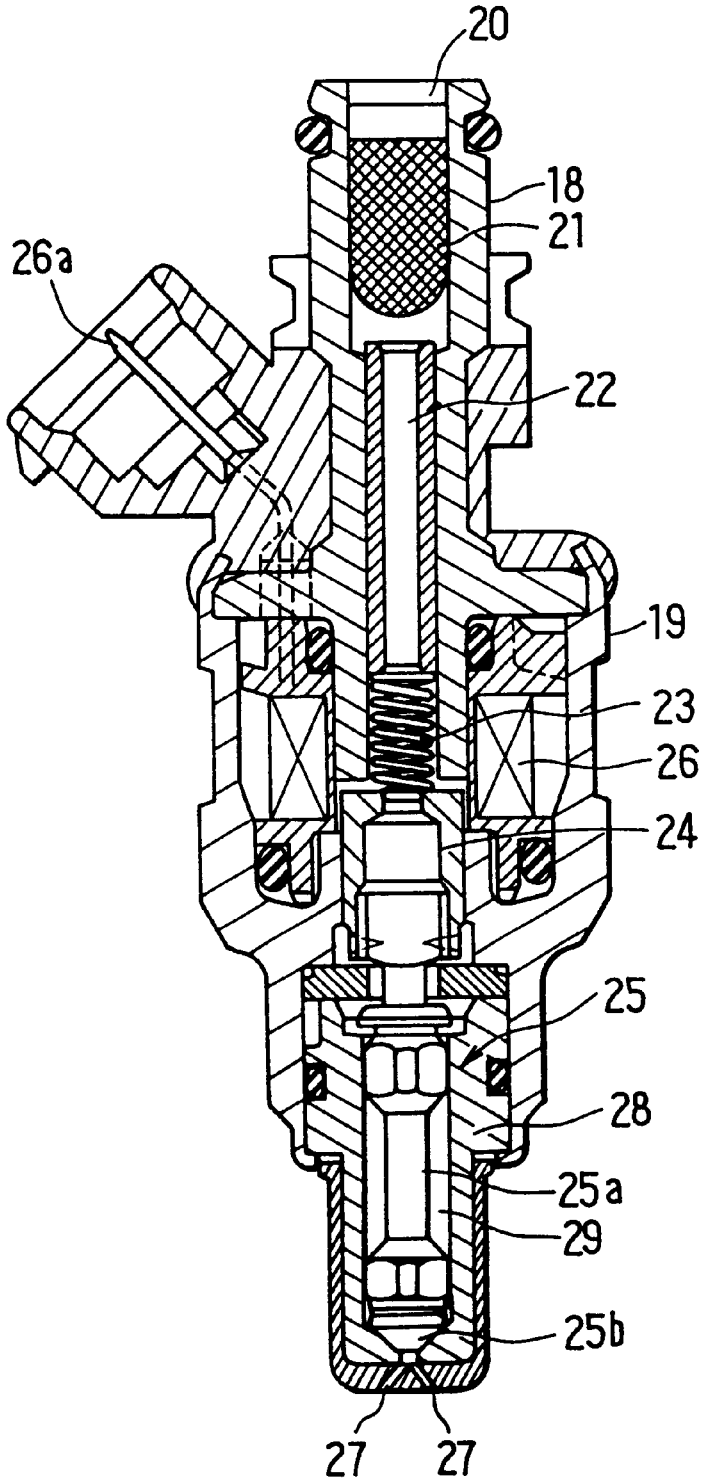
FIG. 6 is a sectional view showing the fuel injection valve according to the first embodiment.
Figure 7:
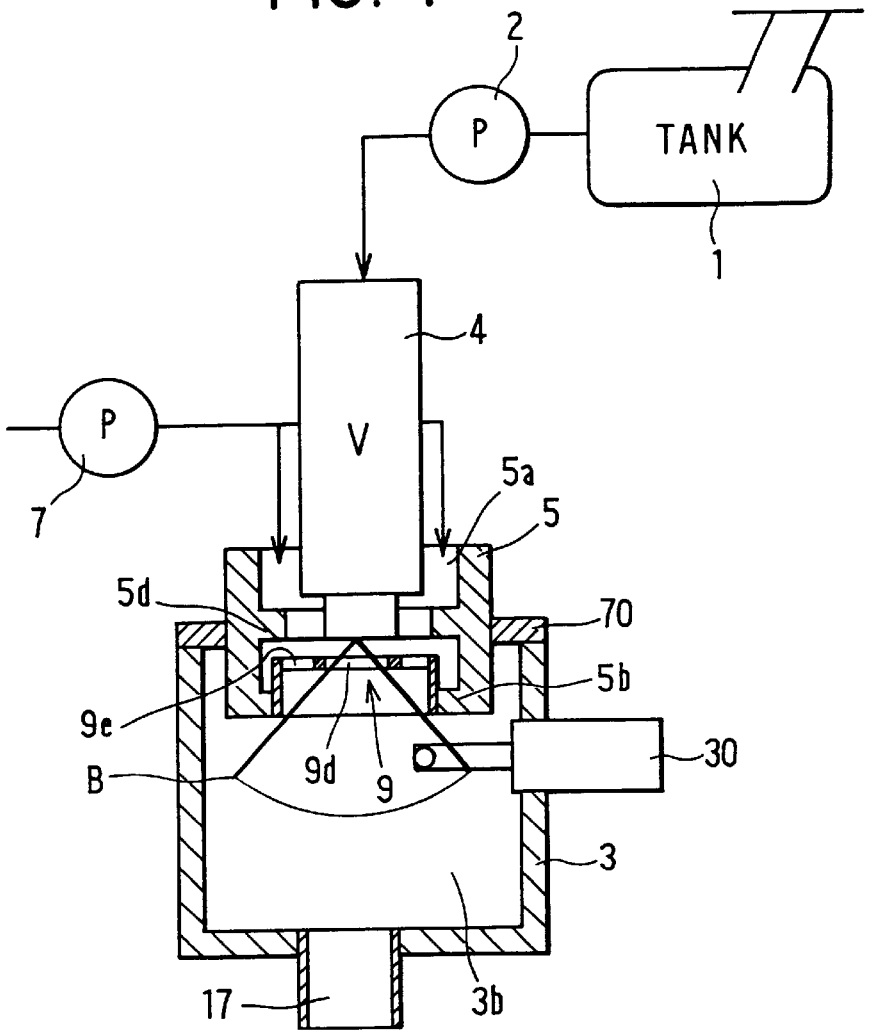
FIG. 7 is a partially vertical sectional view showing a combustion device according to a second preferred embodiment of the present invention.

Next, the structure of the fuel injection valve 4 will be described with reference to FIG. 6. As shown in FIG. 6, the fuel injection valve 4 includes metal valve housings 18, 19 each of which is formed into an approximate cylindrical like. A fuel inlet 20 into which fuel pumped from the fuel pump 2 flows is formed at one end of the housing 18. A fuel filter 21 is disposed in the fuel inlet 20, and a fuel passage 22 is provided at a downstream side of the filter 21. A coil spring 23 is disposed at a downstream top end portion of the fuel passage 22. The coil spring 23 is an elastic member for pressing a cylindrical plunger 24 in a valve-closing direction (i.e., the lower side in FIG. 6) of a needle valve 25. The plunger 24 is made of a magnetic material. When electrical power is supplied to an electromagnetic coil 26, the plunger 24 is displaced in a valve-opening direction (i.e., upper side in FIG. 6) of the needle valve 25 by electromagnetic force of the electromagnetic coil 26 while resisting the spring force of the coil spring 23.

Because one end of the needle valve 25 is integrally connected to the plunger 24, the needle valve 25 and the plunger 24 are integrally displaced in the up-down direction in FIG. 6. The fuel passage 22 always communicates with a fuel passage 29 around a small-diameter portion 25*a* of the needle valve 25 through inner side spaces of the coil spring 23 and the plunger 24 and through an outer peripheral side of an upper end portion of the needle valve 25. A communication opening between the fuel passage 29 and the injection port 27 is opened and closed by a conical valve portion 25*b* provided at the other end (i.e., lower end) of the needle valve 25.

An ignition plug 30 for generating sparks is attached to the combustion receiver 3 so that an electrode portion of the ignition plug 30 is exposed within the combustion chamber 3*b*. Therefore, mixed gas between fuel and air is ignited in the combustion chamber 3*b* by the sparks generated in the electrode portion of the ignition plug 30.

Figure 4:
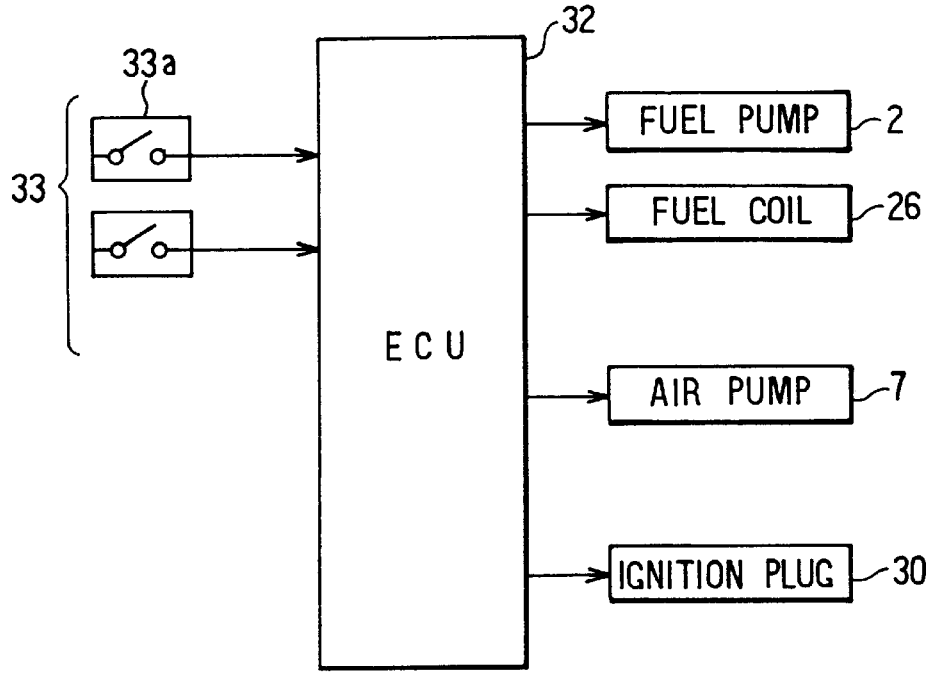
FIG. 4 is a block diagram of a combustion control unit (ECU) according to the first embodiment.

FIG. 4 shows control operation of a combustion control unit (ECU) 32. For example, the combustion control unit 32 is constructed by a microcomputer and circuits around the microcomputer. The combustion control unit 32 performs an electrical control of electrical compartments shown in FIG. 1 by performing predetermined calculations relative to input signals based on a pre-set program. The electrical compartments of the combustion device includes the fuel pump 2, the air pump 7, the electromagnetic coil 26 of the fuel injection valve 4 and the ignition plug 30. Signals from an operation switch group 33 such as a combustion operation switch 33*a* which is operated by a user are input into the combustion control unit 32.

Figure 5:
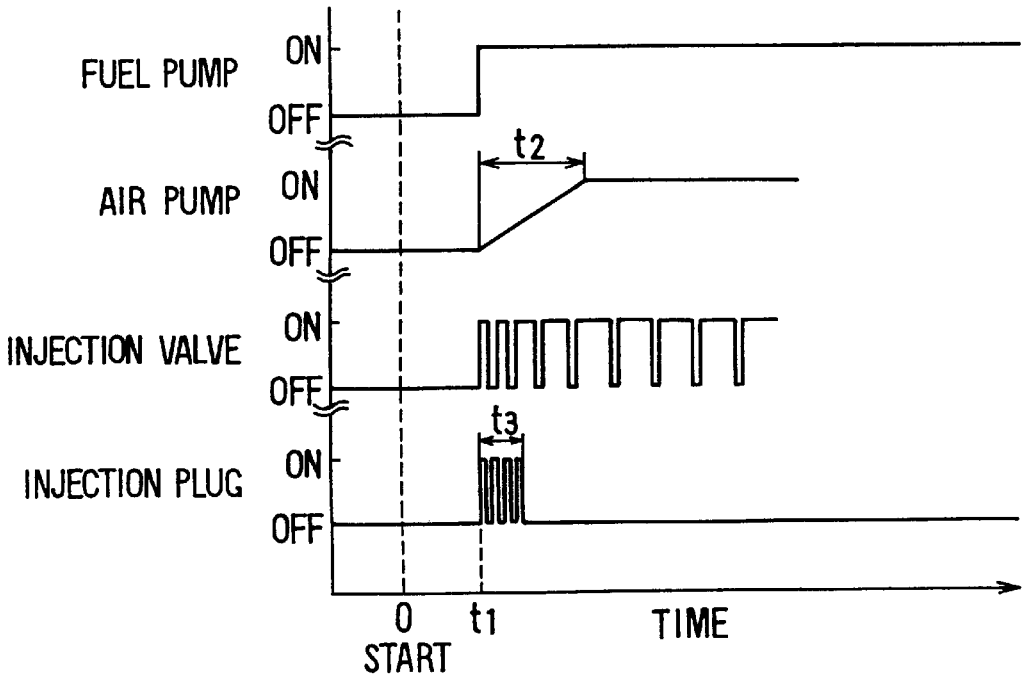
FIG. 5 is graphs showing time operations of a fuel pump, an air pump, a fuel injection valve and an ignition plug after a combustion operation switch is turned on, according to the first embodiment.

FIG. 5 shows time control operations of the combustion control unit 32. At the time position (0) indicated in the horizontal axis in FIG. 5, the combustion operation switch 33*a* is turned on and combustion operation of the combustion device starts. After the combustion operation switch 33*a* is turned on, electrical power is supplied to the fuel pump 2 and the air pump 7 so that the fuel pump 2 and the air pump 7 start to operate. From a start time of the fuel pump 2, the fuel pump 2 is rotated with a predetermined rotation speed. Because the fuel pump 2 rotates with the predetermined rotation speed, fuel within the fuel tank 1 is pressed to have a predetermined pressure.

On the other hand, electrical voltage applied to a motor of the air pump 7 is gradually increased after the air pump 7 starts. Therefore, the rotation speed of the air pump 7 is gradually increased, and air amount supplying to the combustion chamber 3*b* is also gradually increased. Thus, at the combustion starting time, flames are prevented from being blown out by the supplying air. The rotation speed of the air pump 7 is increased to a predetermined rotation speed after a predetermined time t2 passes, by a timer function of the combustion control unit 32.

On the other hand, duty signals for changing a ratio (i.e., duty ratio) between on-operation time and off-operation time is input from the combustion control unit 32 to the electromagnetic coil 26 of the fuel injection valve 4. For example, the duty signals are controlled, so that fuel is injected with a predetermined small fuel amount at the combustion start time (ignition time) and the fuel injection amount is gradually increased after the fuel ignition.

Further, an ignition signal is input from the combustion control unit 32 to the ignition plug 30 during a predetermined time t3 so that sparks are generated at the electrode portion of the ignition plug 30 only during the predetermined time t3. After combustion of mixed gas between fuel and air is started, the combustion is continuously performed by the combustion heat. Therefore, the ignition signal into the ignition plug 30 is generated only during the predetermined time t3. In the first embodiment, the fuel supplying amount is adjusted by the duty signal into the electromagnetic coil 26 of the fuel injection valve 4, and the air supplying amount is adjusted by adjusting the rotation speed of the air pump 7. Therefore, it is possible to adjust the combustion amount of the combustion device.

According to the first embodiment of the present invention, as shown in FIGS. 1, 2, fuel injected from the fuel injection valve 4 is introduced into the combustion chamber 3*b* after passing through the fuel flowing hole 9*d* of the fuel collision member 9. On the other hand, air pumped from the air pump 7 is introduced into the combustion chamber 3*b* through the air introduction portion 5*a* formed around the fuel injection valve 4, an inner side of the throttle member 8 and air flowing hole 9*e* of the fuel collision member 9.

In the first embodiment, the fuel collision member 9 and the fuel injection valve 4 are positioned so that a part of fuel injected from the injection ports 27 collides with the edge portion 9*f* of the fuel flowing hole 9*d* of the fuel collision member 9, and the other part of fuel injected from the injection ports 27 is directly introduced into the combustion chamber 3*b* without colliding with the edge portion 9*f*. In FIG. 1, "A" indicates a locus of collision fuel after collision. Because fuel colliding with the edge portion 9*f* is atomized by collision energy, the atomized fuel is readily gasified even when the combustion chamber 3*b* is cooled in a normal temperature at a combustion starting time, and is readily mixed with air. Thus, mixed gas is immediately readily ignited in the combustion chamber 3*b* by the sparks of the ignition plug 30, and an ignition delay is prevented.

Further, in the first embodiment, because the inner diameter of the throttle member 8 is set to be smaller than the diameter of the air introduction port 5*a*, air passing through the inner side of the throttle member 8 is disturbed. Therefore, air passing through around the fuel injection valve 4 cools the fuel injection valve 4, and heat-transmitting performance of air is improved. As a result, even when heat is transmitted from the combustion chamber 3*b* to the fuel injection valve 4, the fuel injection valve 4 is effectively cooled by air.

Figure 3:
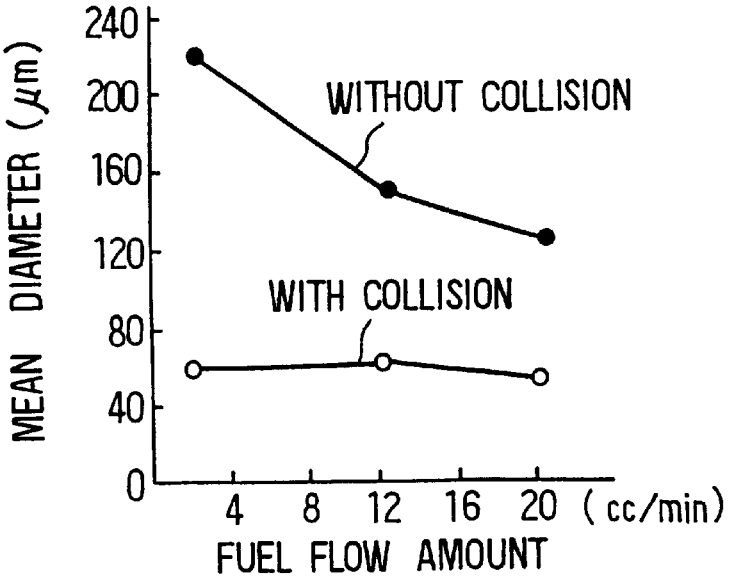
FIG. 3 is a characteristic view showing an fuel collision effect according to the first embodiment.

FIG. 3 shows the relationship between the mean diameter of fuel and the fuel collision, relative to a variation in a fuel flow amount injected from the fuel injection valve 4, when the pressure of fuel injected from the fuel injection valve 4 is set to 250 kPa and the injection frequency of the fuel injection valve 4 is set to 80 Hz. As shown in FIG. 3, in the first embodiment, because the collision member 9 is provided so that injection fuel collides with the collision member 9, the mean diameter of fuel is maintained at an approximate constant minute value regardless of the variation in the injected fluid flow amount. However, in a comparison example without the collision member 9, the mean diameter of injection fuel does not become sufficiently minute, and is changed with the injected fuel flow amount.

On the other hand, during a normal combustion after a predetermined time passes after the combustion starts with the ignition of the mixed gas, when fuel is distributed uniformly in the combustion chamber 3*b*, fuel is not sufficiently mixed with air, and combustion performance of the mixed gas is deteriorated. However, according to the first embodiment, a part of fuel injected from the fuel injection valve 4 is directly introduced into the combustion chamber 3*b* through the fuel flowing hole 9*d* of the collision member 9 without being affected by the collision member 9. In FIG. 2, "B" indicates the locus of fuel which does not collide with the edge portion 9*f* of the collision member 9. Therefore, fuel directly introduced into the combustion chamber 3*b* is uniformly distributed within the combustion chamber 3*b*. Thus, mixing performance between fuel and air is improved, combustion performance of the mixed gas is improved, and hazardous substance contained in the exhaust gas is reduced.

A second preferred embodiment of the present invention will be now described with reference to FIGS. 7–10. In the second embodiment of the present invention, a collision operation mode where fuel injected from the fuel injection valve 4 collides with the collision portion 9 or a non-collision operation mode where fuel injected from the fuel injection valve 4 does not collides with the collision portion 9 is set in accordance with temperature within the combustion chamber 3*b*. In the second embodiment, components similar to those in the first embodiment are indicated with the same reference number, and the explanation thereof is omitted.

Figure 8:
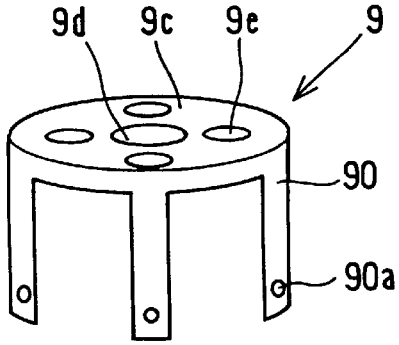
FIG. 8 is a perspective view of a fuel collision member according to the second embodiment.
Figure 9:
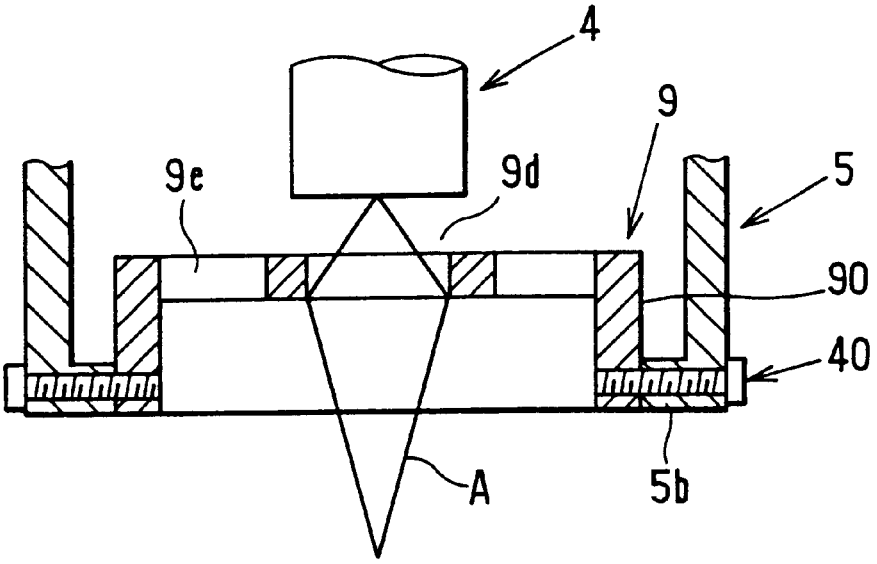
FIG. 9 is a sectional view for explaining a fuel injection operation from a fuel injection valve according to the second embodiment.
Figure 10:
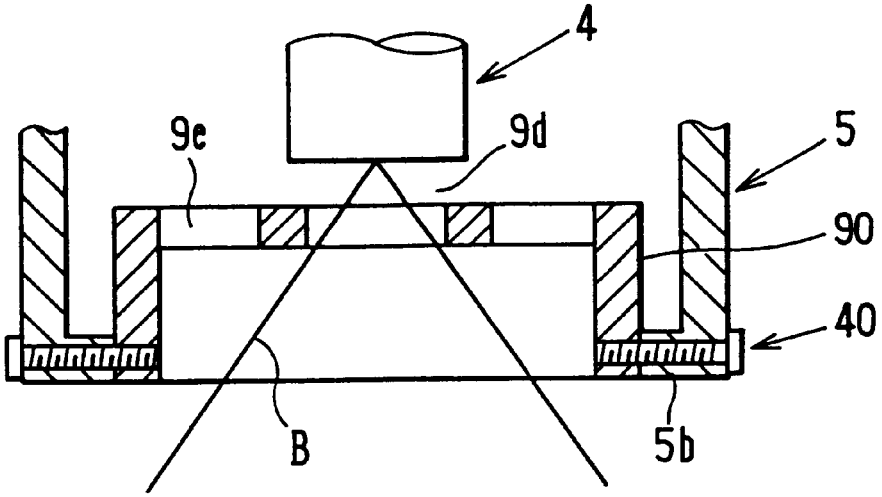
FIG. 10 is a sectional view for explaining an another fuel injection operation of the fuel injection valve according to the second embodiment.

In the second embodiment, as shown in FIG. 8, four leg portions 90 are integrally formed with the plate portion 9*c* of the fuel collision member 9 to have a predetermined distance between adjacent two. Each of the four leg portions 90 has a hole portion 90*a* at a position corresponding to the flange portion 5*b* provided inside the cylindrical portion 5. Therefore, the leg portions 90 of the fuel collision member 9 is fixed to the flange portion 5*b* of the cylindrical portion 5 by screwing screws 40 into the hole portions 90*a*, as shown in FIGS. 8, 9.

The fuel collision member 9 is made of aluminum having thermal expansion coefficient of $31\times10^{-6}$/k. Further, the cylindrical portion 5 is made of nickel chrome steel having thermal expansion coefficient of $12\times10^{-6}$/k. Thus, when the temperature within the combustion chamber 3*b* is 500° C., the leg portion 90 of the fuel collision member 9 are thermal-expanded approximately by 0.2 mm, the plate portion 9*c* is thermal-expanded approximately by 0.2 mm, and therefore, the fuel collision member 9 becomes close to the fuel injection side of the fuel injection valve 4.

In the second embodiment, combustion gas within the combustion chamber 3*b* is introduced to an outer side through the exhaust gas outlet 17 to be different from that of the first embodiment. Further, the combustion chamber 3*b* is closed by a cover member 70 of the combustion receiver 3. On the other hand, in the second embodiment, a throttle portion 5*d* corresponding to the throttle portion 8 of the first embodiment is provided in the cylindrical portion 5.

Next, operation of a combustion device according to the second embodiment will be now described. When the temperature within the combustion chamber 3*b* is the normal temperature, e.g., at the ignition time of the mixed gas between fuel and air, a distance between the plate portion 9*c* of the fuel collision portion 9 and the fuel injection side (i.e., fuel injection holes) of the fuel injection valve 4 becomes larger. As a result, all fuel injected from the fuel injection valve 4 collides with an inner wall for defining the fuel flowing hole 9*d* of the fuel collision member 9, and thereafter is introduced into the combustion chamber 3*b*. Therefore, fuel injected from the fuel injection valve 4 is sufficiently atomized, gasification of the injection fuel is facilitated even in the normal temperature, and the mixing performance between the injection fuel and air is improved.

On the other hand, with the fuel combustion within the combustion chamber 3*b*, combustion heat is transmitted to the fuel collision member 9. When the temperature of the combustion chamber 3*b* is increased to approximately 500° C., the four leg portions 90 and the plate portion. 9*c* are thermal-expanded based on a coefficient different of thermal expansion between the fuel collision member 9 and the cylindrical portion 5. Because the leg portions 90 of the fuel collision member 9 are thermal-expanded approximately by 0.2 mm, and the plate portion 9*c* is thermal-expanded approximately by 0.2 mm, the fuel collision member 9 becomes close to the fuel injection side of the fuel injection valve 4. By the thermal expansion operation of the fuel collision member 9, fuel injected from the fuel injection valve 4 does not collide with the inner wall defining the fuel flowing hole 9*d* of the fuel collision member 9 and is directly introduced into the combustion chamber 3*b* in a wide range as shown by the fuel locus "B" in FIG. 10. Therefore, fuel injected from the fuel injection valve 4 is uniformly distributed into the combustion chamber 3*b*, and the mixing performance between fuel and air is improved.

According to the second embodiment of the present invention, based on a degree of the thermal expansion of the fuel collision member 9 due to the variation in the temperature of the combustion chamber 3*b*, the collision operation mode where injection fuel is introduced into the combustion chamber 3*b* with the collision and the non-collision operation mode where injection fuel is directly introduced into the combustion chamber 3*b* without the collision are selectively switched.

Thus, in the second embodiment, during the normal combustion of the combustion device, all fuel injected from the fuel injection valve 4 is directly introduced into the combustion chamber 3*b* without colliding with the fuel collision portion 9. Therefore, the injection fuel can be introduced into a wider range within the combustion chamber 3*b*, as compared with the first embodiment.

Further, in the second embodiment, the ignition plug 30 is fixed to the combustion receiver 3 so that injection fuel contacts the electrode portion of the ignition plug 30 in any one of the collision operation mode and the non-collision operation mode.

Figure 11:
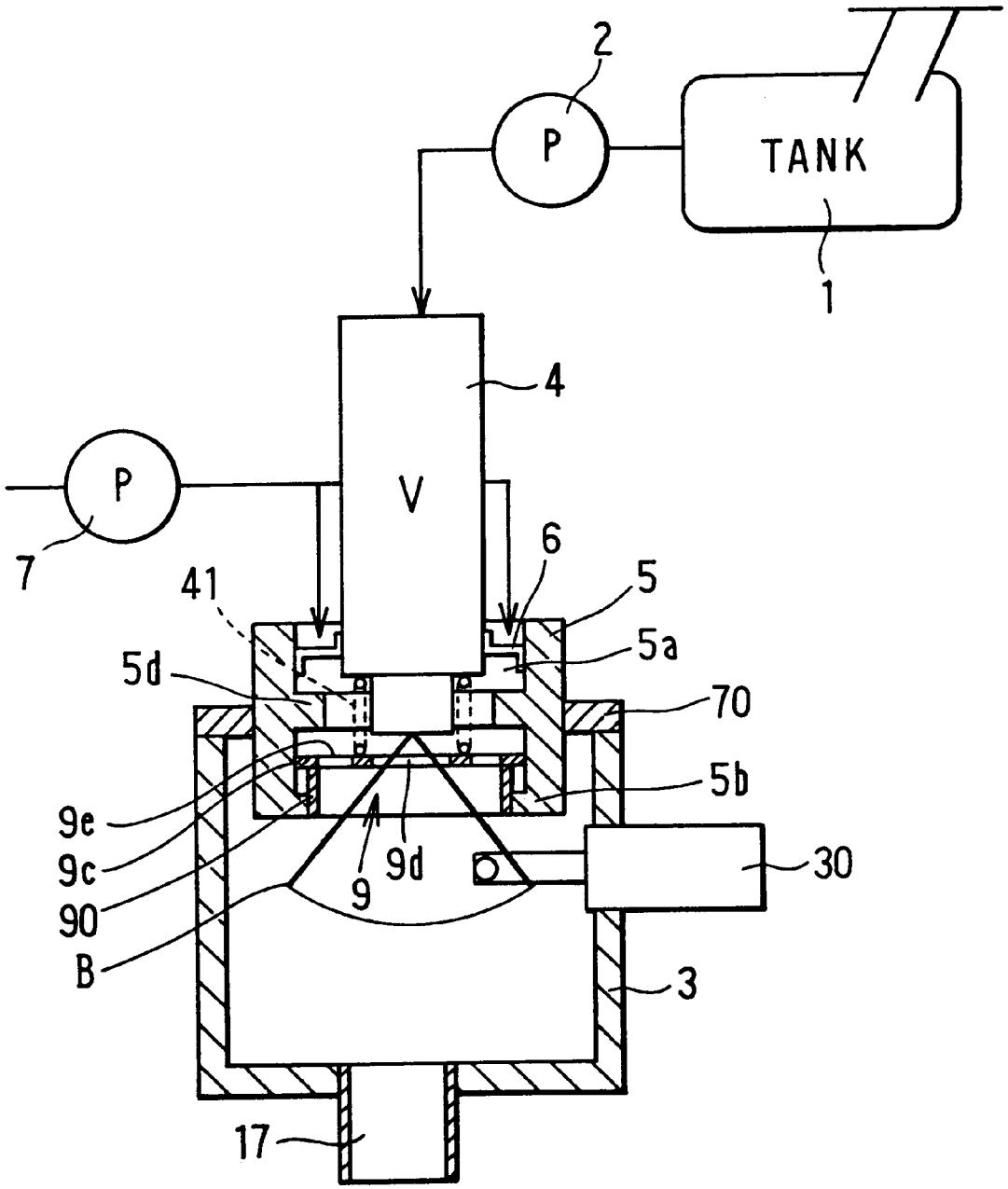
FIG. 11 is a partially vertical sectional view showing a combustion device according to a third preferred embodiment of the present invention.

A third preferred embodiment of the present invention will be now described with reference to FIG. 11. FIG. 11 shows a combustion device of the third embodiment. In the above-described second embodiment, all of the fuel collision member 9 including the plate portion 9*c* are made aluminum. However, in the third embodiment, only the leg portions 90 are made of aluminum, and the plate portion 9*c* of the fuel collision member 9 are made of nickel chrome steel, similarly to that of the cylindrical portion 5. The plate portion 9*c* is disposed on the leg portions 90, and a distance between the fuel injection side of the fuel injection valve 4 and the plate portion 9*c* is set by a coil spring 41 disposed between the fuel injection valve 4 and the plate portion 9*c*. Therefore, when the plate portion 9*c* becomes close to the fuel injection side of the fuel injection valve 4 by the thermal expansion of the leg portions 90, the coil spring 41 is compressed. In the third embodiment, the other portions are similar to those in the above-described second embodiment, and operation is also similar to that of the second embodiment and the explanation thereof is omitted.

A fourth preferred embodiment of the present invention will be now described with reference to FIGS. 12–15. In the fourth embodiment, for selectively switching the collision operation mode and the non-collision operation mode for fuel injected from the fuel injection valve 4, the pressure of air is used.

In the fourth embodiment, at the fuel injection side of the fuel injection valve 4, a valve member 56 is provided. As shown in FIGS. 12, 13A–13C, the valve member 56 includes a coil spring 53, and a valve portion 52 having an opening 50 through which injection fuel passes and four openings 51 through which air from the air pump 7 passes.

Figure 12:
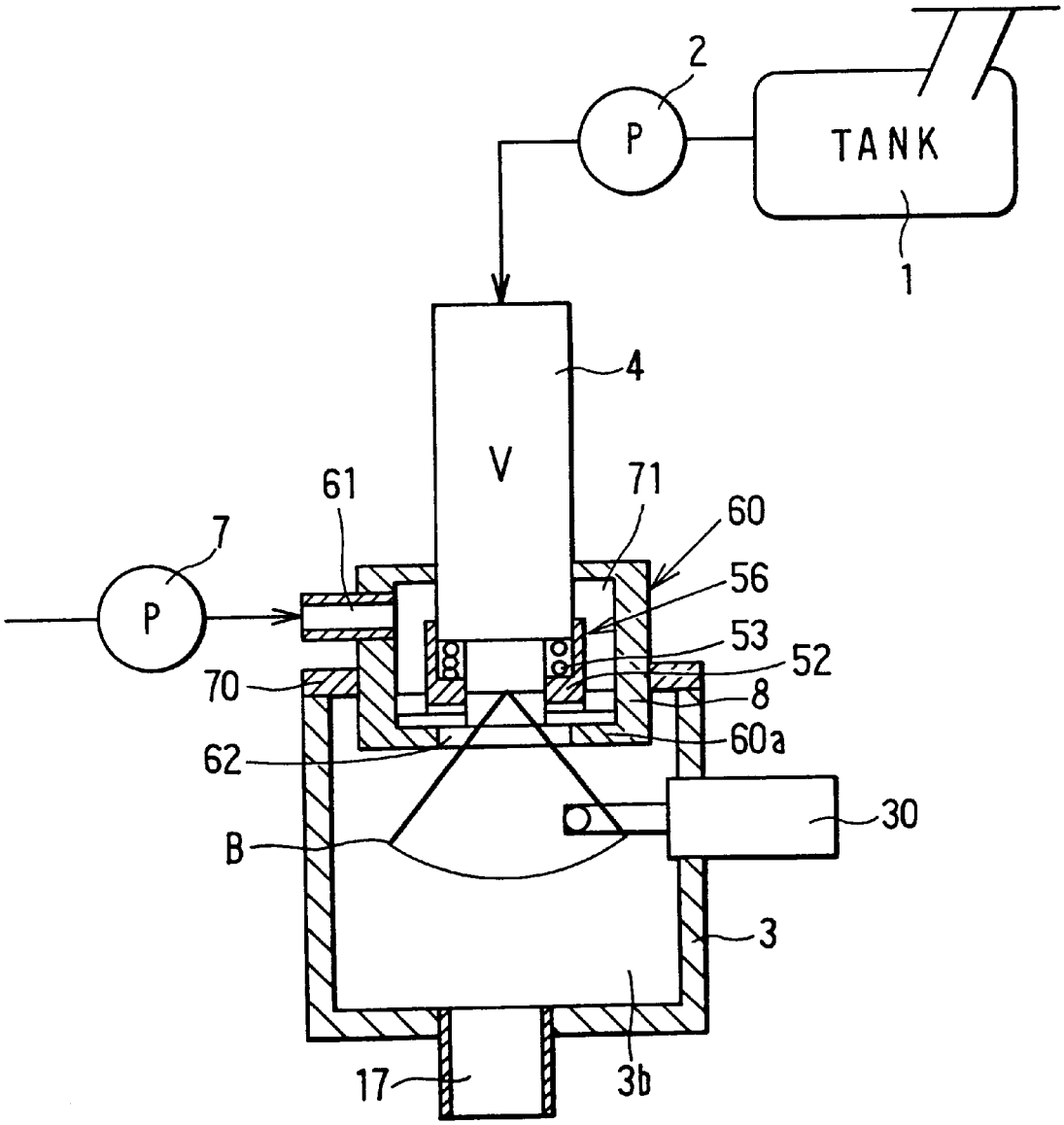
FIG. 12 is a partially vertical sectional view showing a combustion device according to a fourth preferred embodiment of the present invention.

Specifically, as shown in FIG. 12, a housing 60 is disposed at the fuel injection side of the fuel injection valve 4 to form an air introduction chamber 71. The housing 60 is attached to the cover portion 70 of the combustion receiver 3. An air pipe 61 is connected to the housing 60 so that an axial line of the air pipe. 61 is crossed with an axial line of the fuel injection valve 4.

Figure 13A:
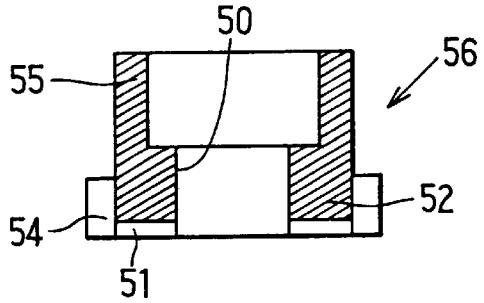
FIG. 13A is a sectional view showing a valve portion of a valve member in FIG. 12.
Figure 13B:
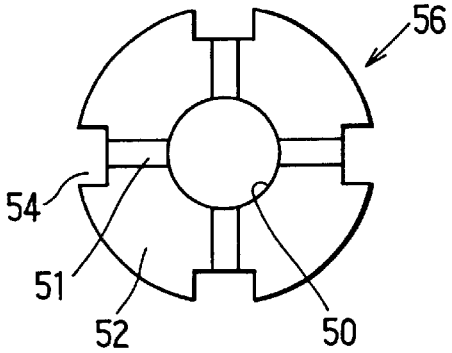
FIG. 13B is a bottom view of FIG. 13A.
Figure 13C:
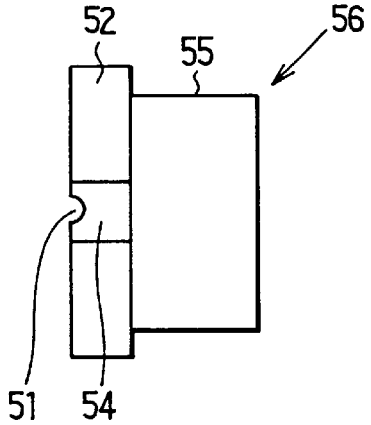
FIG. 13C is a side view of FIG. 13A.

As shown in FIGS. 13A, 13B, 13C, the four openings 51 are provided in the bottom surface of the valve portion 52 of the valve member 56. Each one end of the four openings 51 communicates with the opening 50 through which injection fuel passes, the other ends thereof respectively communicate with recess portions 54. Therefore, the openings 51 communicate with the air introduction chamber 71 of the housing 60 through the recess portions 54. Further, a circular flange portion 55 is provided on a surface of the valve portion 52 of the valve member 56. An inner end surface of the flange portion 55 contact the outer peripheral side of the fuel injection valve 4.

As shown in FIG. 12, spring force of a coil spring 53 is applied in a direction where the valve portion 52 of the valve member 56 presses a circular flange portion 60*a* around an opening 62 of the housing 60.

Next, operation of a combustion device according to the fourth embodiment will be now described. In the fourth embodiment, air pumped from the air pump 7 is firstly introduced into the air introduction chamber 71, and is introduced into the combustion chamber 3*b* through the recess portion 54 of the valve portion 52 of the valve member 56, the openings 51, the opening 50 and the opening 62 of the housing 60.

Figure 14:
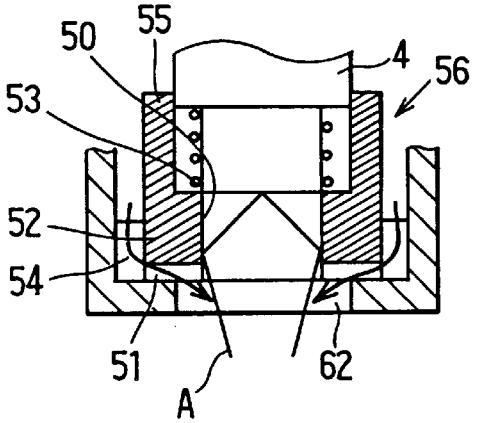
FIG. 14 is a sectional view for explaining a fuel injection operation from a fuel injection valve according to the fourth embodiment.

When an air amount introduced from the air pump 7 to the air introduction chamber 71 is small in a case such as the ignition time, the pressure of air passing through the openings 51 of the valve portion 52 of the valve member 56 is relatively low. Therefore, compression load of the valve portion 52 due to the coil spring 53 is larger than the pressure of air, and the compression state of the valve portion 52 is maintained. As a result, as shown in FIG. 14, fuel injected from the fuel injection valve 4 collides with an inner wall for defining the opening 50 of the valve portion 52 to be atomized, and the atomized fuel is introduced into the combustion chamber 3*b*, as shown by the fuel locus A in FIG. 14.

Figure 15:
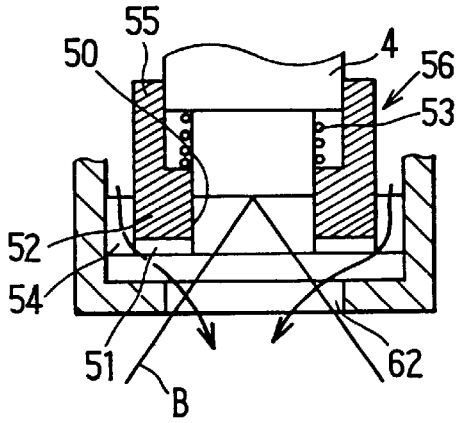
FIG. 15 is a sectional view for explaining an another fuel injection operation from the fuel injection valve according to the fourth embodiment.

On the other hand, in the normal combustion state, because the air amount introduced from the air pump 7 to the air introduction chamber 71 becomes larger, the pressure of air passing through the openings 51 of the valve portion 52 of the valve member 56 becomes relatively higher. Therefore, pressure of air becomes larger than the compression load of the valve portion 52 due to the coil spring 55, and the valve portion 52 is moved in the upper direction (i.e., in a direction pressure-reducing the coil spring 55) in FIG. 14. As a result, as shown in FIG. 15, the valve member 56 is moved relatively close to the fuel injection valve 4, and therefore, fuel injected from the fuel injection valve 4 is introduced into the combustion chamber 3*b* in a wide range through the opening 62 of the housing 60 without colliding with the inner wall for defining the opening 50 of the valve portion 52, as shown by the fuel locus "B" in FIG. 15. Accordingly, in the combustion device of the fourth embodiment, the collision operation mode and the non-collision operation mode are selectively switched in accordance with the pressure of air to be introduced into the combustion chamber 3*b*.

A fifth preferred embodiment of the present invention will be now described with reference to FIGS. 16–21. In the fifth embodiment, the structure of a combustion device is different from that described in the above-described first to fourth embodiments. However, the components similar to those in the above-described embodiments are indicated with the same reference numbers.

Figure 16:
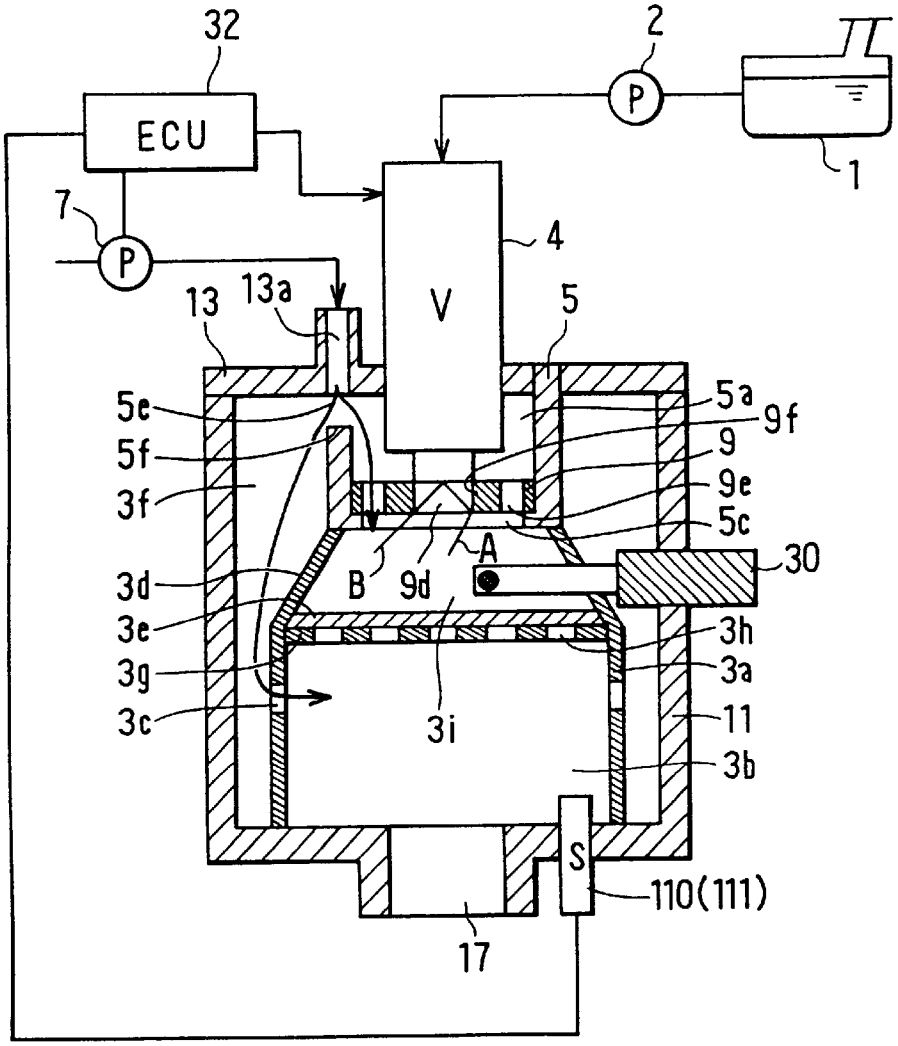
FIG. 16 is a partially vertical sectional view showing a combustion device according to a fifth preferred embodiment of the present invention.

As shown in FIG. 16, a combustion receiver 3 of the combustion device includes a cylindrical outer wall 3*a* having plural air introduction ports 3*c*, and a cylindrical air cylinder 3*d*. A vertical sectional shape of the air cylinder 3*d* is set so that a width dimension thereof become gradually larger toward a connection position where the outer wall 3*a* and the air cylinder 3*d* are connected. A partition plate 3*g* for partitioning an interior of the combustion receiver 3 into the combustion chamber 3*b* and the mixing chamber 3*i* is disposed to extend horizontally at the connection position. Thus, in the fifth embodiment, both the mixing chamber 3*i* and the combustion chamber 3*b* communicate with each other through plural communication holes 3*h* formed in the partition plate 3*g*. A plate-like porous member 3*e* is fixed onto the partition plate 3*g* at a side of the mixing chamber 3*i*. The porous member 3*e* adsorbs liquid fuel to be held therein, and liquid fluid is possible to be evaporated from the porous member 3*e*. The porous member 3*e* is made of a porous material such as foam metal. Therefore, in the fifth embodiment, even after a fuel heating due to the ignition plug 30 is stopped, the evaporation of fuel is effectively facilitated. In the porous member 3*e*, communication holes having the same sizes as the communication holes 3*h* of the partition plate 3*g* may be provided at the same positions as the communication holes 3*h*.

The ignition plug 30 is fixed to a housing 11 to protrude into the mixing chamber 3*i*. A spark portion of the ignition plug 30 is disposed inside an injection angle of injection fuel from the fuel injection valve 4, i.e., inside a cone locus portion of injection fuel. However, the spark portion of the ignition plug 30 may be disposed outside the cone locus portion of injection fuel.

An air passage 3*f* is formed between the housing 11 and the combustion receiver 3. Air introduced from an air inlet 13*a* is divided into the air introduction portion 5*a* of the cylinder portion 5 and the air passage 3*f*. Air divided into the air passage 3*f* is supplied to the combustion chamber 3*b* of the combustion receiver 3 through air introduction ports 3*c* provided in the other wall 3*a*. Air divided into the air introduction portion 5*a* of the cylindrical portion 5 is throttled in the air flowing holes 9*e* of the fuel collision member 9. Therefore, air supplying into the mixing chamber 3*i* becomes smaller, and the fuel amount becomes in a rich state among the mixed gas within the mixing chamber 3*i*.

Figures 17A, 17B:
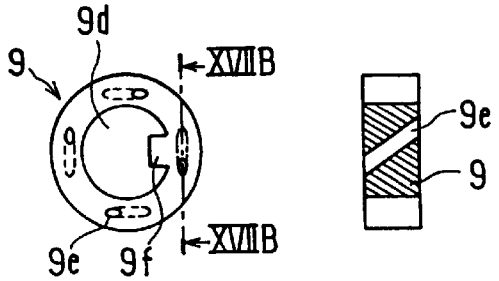
FIG. 17A is a plan view showing a fuel collision member according to the fifth embodiment.
FIG. 17B is a cross-sectional view taken along line XVIIB—XVIIB in FIG. 17A.

Next, the structure of the fuel collision member 9 according to the fifth embodiment will be now described. As shown in FIGS. 17A, 17B, each of the plural air flowing holes 9*e* is formed to be inclined by a predetermined angle so that air passing through the air flowing holes 9*e* revolves. On the other hand, a protrusion 9*f* protruding from the inner wall defining the fuel flowing hole 9*d* is formed to be opposite to one of the air flowing holes 9*e*.

Plural injection holes are formed in the fuel injection valve 4 so that, a part of fuel injected from the injection holes of the fuel injection valve 4 collides with the protrusion 9*f* shown in FIG. 17A, and the other part of fuel injected from the injection holes of the fuel injection valve 4 does not collides with the protrusion 9*f* and the inner wall defining the fuel flowing hole 9*d*. Further, in the fifth embodiment, the injection angle of fuel injected from the injection holes of the fuel injection valve 4 is set to be in a range of 30–50°, for example.

An opening 5*e* is provided in a side wall of the cylindrical portion 5 supporting the fuel collision member 9 at a position so that the air introduction port 13*a* provided in a flange 13 of the housing 11 faces a peripheral wall portion 5*f* defining the opening 5*e*. Therefore, air from the air pump 7 collides with the peripheral wall portion 5*f* defining the opening portion 5*e* to be introduced into the air introduction portion 5*a* of the cylindrical portion 5 and the air passage 3*f*.

Next, a control operation of the fuel injection frequency of the fuel injection valve 4 will be described. In the fifth embodiment, the fuel injection frequency of the fuel injection valve 4 is controlled by the combustion control unit (ECU) 32 according to an oxygen density within the combustion chamber 3*b*. The oxygen density within the combustion chamber 3*b* is detected by an oxygen sensor 110 constructed by an oxygen concentration cell. The oxygen sensor 110 is attached to protrude into the combustion chamber 3*b* at a wall portion proximate to a gas exhaust port 17 of the housing 11. In the fifth embodiment, an output value (output signal) from the oxygen sensor 110 is a comparison difference between a standard oxygen (e.g., atmospheric oxygen) and the oxygen density within the combustion chamber 3*b*. Therefore, as the oxygen density within the combustion chamber 3*b* becomes higher, the output value from the oxygen sensor 110 becomes smaller. On the other hand, as the oxygen density within the combustion chamber 3*b* becomes smaller, the output value from the oxygen sensor 110 becomes larger.

Signals from the oxygen sensor 110 is input into the combustion control unit 32 of the combustion device, and the fuel injection frequency of the fuel injection valve 4 is controlled based on the input signal.

Figure 18:
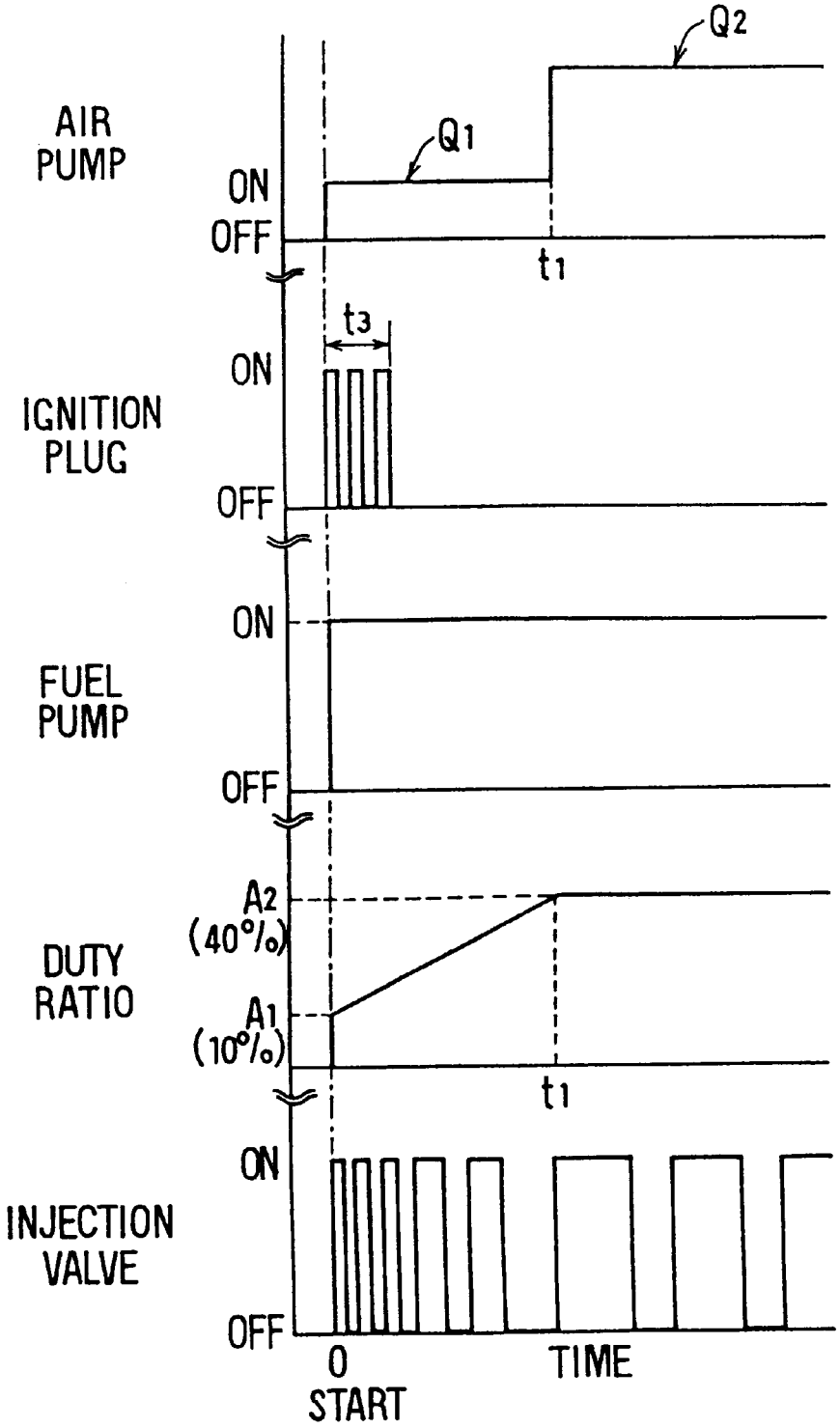
FIG. 18 is graphs showing time operations of an air pump, an ignition plug, a fuel pump, a duty ratio of a fuel injection valve and an opening/closing of the fuel injection valve, after a combustion operation switch is turned on, according to the fifth embodiment.
Figure 19:
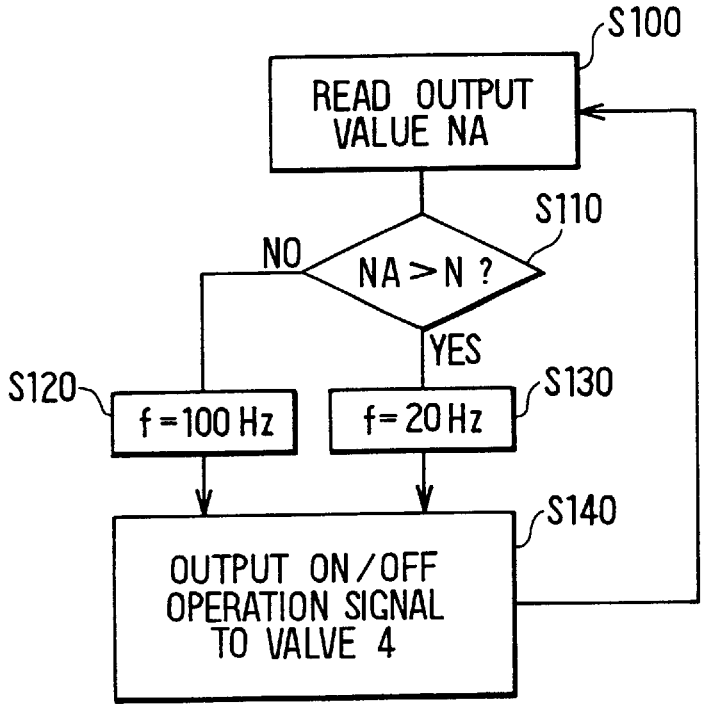
FIG. 19 is a flow diagram showing a control operation of a combustion control unit (ECU) of the combustion device according to the fifth embodiment.

Next, operation of the combustion device according to the fifth embodiment will be now described. FIG. 18 shows a control operation of the combustion device due to the combustion control unit 32. At the position zero in the horizontal axis of FIG. 18, the combustion operation switch 33*a* is turned on, and the operation of the combustion device is started. Firstly, electrical power is supplied to the fuel pump 2 and the air pump 7 to starts operations of both pumps 2, 7. Here, the fuel pump 2 is rotated by a predetermined normal rotation speed from at a start time. By the rotation of the fuel pump 2 with the predetermined rotation speed, pressure of fuel within the fuel tank 1 is increased to a predetermined pressure. On the other hand, the air pump 7 is firstly rotated with a first predetermined rotation speed corresponding to an air amount Q1 from at the start time. After a predetermined time t1 passes, the air pump 7 is rotated with a second rotation speed corresponding to the air amount Q2 larger than the air amount Q1.

On the other hand, the oxygen density within the combustion chamber 3*b* is detected by the oxygen sensor 110, and the output signal from the oxygen sensor 110 is input into the combustion control unit 32. In a determination part of the combustion control unit 32, it is determined whether or not the output value from the oxygen sensor 110 is higher than a predetermined value. When the output value from the oxygen sensor 110 is lower than the predetermined value, it is determined that the oxygen density within the combustion chamber 3*b* is higher than a predetermined density, and a signal where the needle valve 25 (see FIG. 6) of the fuel injection valve 4 is vibrated with a frequency of 100 Hz between a valve-closing position and a valve-opening position is input to the electromagnetic coil 26 (see FIG. 6) of the fuel injection valve 4. On the other hand, when the output value from the oxygen sensor 110 is higher than the predetermined value, it is determined that the oxygen density within the combustion chamber 3*b* is lower than the predetermined density, and a signal where the needle valve 25 (see FIG. 6) of the fuel injection valve 4 is vibrated with a frequency of 20 Hz is input to the electromagnetic coil 26 (see FIG. 6) of the fuel injection valve 4.

Further, a duty signal for changing a duty ratio (i.e., a ratio of turning-on time to turning-off time) is input into the electromagnetic coil 26 of the fuel injection valve 4 from the combustion control unit 32. In the fifth embodiment, the duty signal is controlled in such a manner that fuel is injected with a predetermined minimum amount at the ignition time, and the fuel injection amount is gradually increased after the fuel ignition. That is, as shown in FIG. 18, the duty ratio is set to A1 immediately after the combustion start operation of the combustion device. Thereafter, during the predetermined time t1 after the combustion operation of the combustion device starts, the duty ratio is gradually increased. After the predetermined time t1 passes, the duty ratio is set at A2.

Electrical power (ignition signal) is supplied to the ignition plug 30 only during a predetermined time t3. Therefore, only during the predetermined time t3, sparks are generated in the electrode portion of the ignition plug 30. Because the combustion is continuously performed by the combustion heat after the combustion of the mixed gas starts, the ignition signals from the combustion control unit 32 to the ignition plug 30 is generated only during the predetermined time t3. In the fifth embodiment, the fuel supplying amount is adjusted by the duty ratio into the electromagnetic coil 26 of the fuel injection valve 4 and air supplying amount is adjusted by the rotation speed adjustment of the air pump 7, so that the combustion amount of the combustion device is adjusted.

In an initial time of the combustion, because fuel is difficult to be ignited, a consumption oxygen amount becomes smaller, and oxygen stays in the combustion chamber 3*b* with a high density. Therefore, the output volume from the oxygen sensor 110 becomes smaller. As shown by the flow diagram in FIG. 19, at step S100, an output valve NA from the oxygen sensor 110 is read into the combustion control unit 32. Next, in the determination part of the combustion control unit 32, it is determined whether or not the output valve NA from the oxygen sensor 110 is larger than a predetermined value N. When the output value NA is not larger than the predetermined value N, the combustion control unit 32 controls the needle valve 25 of the fuel injection valve 4 to be vibrated with the frequency of 100 Hz. Therefore, fuel injected from the fuel injection valve 4 is atomized. Further, at step S140, an on/off operation signal is output from the combustion control unit 32 to the electromagnetic coil 26 of the fuel injection valve 4.

Further, a part of the atomized injection fuel collides with the protrusion 9*f* formed in the inner wall defining the fuel flowing hole 9*d* of the fuel collision member 9. Thus, according to the fifth embodiment, in the initial time of the combustion, in addition to the fuel atomization due to the high-frequency fuel injection of the fuel injection valve 4, the injected fuel is further atomized by colliding with the protrusion 9*f*. Therefore, at the initial time of the combustion, the mixing performance between the injection fuel and combustion air is improved. Thus, an ignition delay time is greatly reduced.

On the other hand, when the mixing performance between the injection fuel and combustion air is improved and the combustion becomes in the normal combustion state, a large amount of air is used for the combustion. Therefore, the output value NA from the oxygen sensor 110 becomes larger than the predetermined value N at step S110. Therefore, at step S130, the combustion control unit 32 controls the electromagnetic coil 26 so that the needle valve 25 of the fuel injection valve 4 is vibrated with the frequency of 20 Hz. Thus, the injection fuel is introduced in a large liquid-drop state. However, in this case, because the combustion device operates in the normal state, the combustion of the combustion device does not become unstable.

Figure 20:
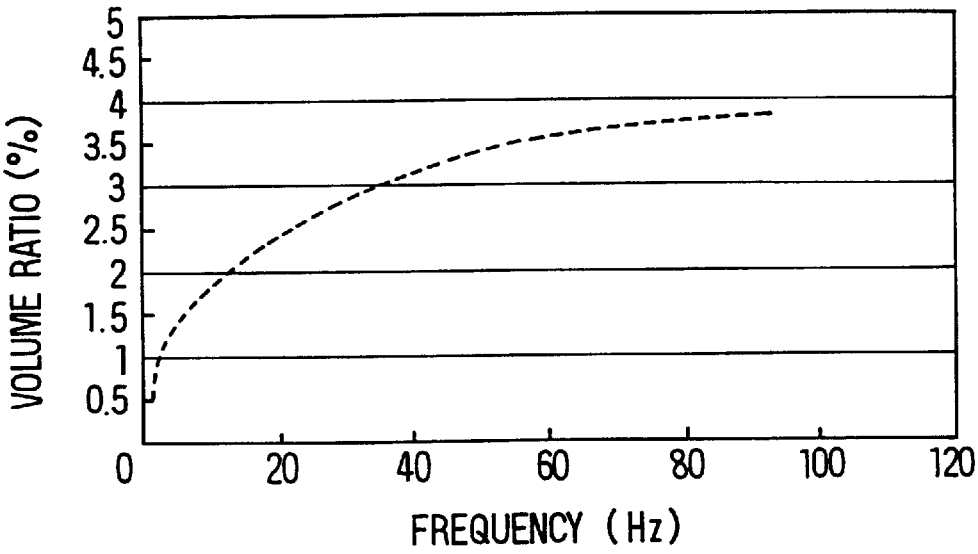
FIG. 20 is a characteristic view showing the relationship between a volume ratio of atomized fuel to an entire injection fuel, and a frequency of a fuel injection of the fuel injection valve, according to the fifth embodiment.
Figure 21A:
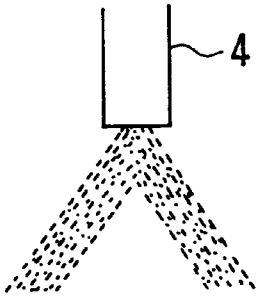
FIG. 21A is a schematic view showing a fuel injection state in a high-frequency fuel injection.
Figure 21B:
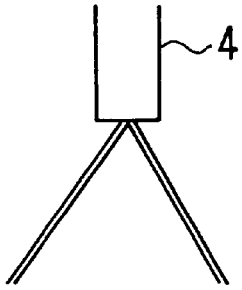
FIG. 21B is a schematic view showing a fuel injection state in a low-frequency fuel injection, according to the fifth embodiment.

FIG. 20 shows the relationship between a volume ratio of atomized fuel having a fine diameter equal to or lower than 50 $\mu$m to an all injection fuel, and the fuel injection frequency of the fuel injection valve 4. In FIG. 20, the injection fuel amount is an injection amount corresponding to a heat-radiating amount of 6 kw within the combustion chamber 3*b*. As shown in FIG. 20, with an increase of the fuel injection frequency of the fuel injection valve 4, the volume ratio of atomized fuel having the fine diameter equal to or smaller than 50 $\mu$m to the entire injection fuel is increased. FIG. 21A is a schematic view showing a fuel injection state in a high-frequency fuel injection (e.g., 100 Hz), and FIG. 21B is a schematic view showing a fuel injection state in a low-frequency fuel injection (e.g., 20 Hz). As shown in FIG. 21A, in the high-frequency fuel injection, fuel is injected in an atomized state. On the other hand, as shown in FIG. 21B, in the low-frequency fuel injection, fuel is injected in a liquid line shape.

In the fifth embodiment, the injection fuel and the air are mixed in the mixing chamber 3*i* to become the mixed gas. However, because the mixed gas is set in the mixing chamber 3*i* to have a rich fuel relative to air, the injected fuel does not completely burn.

However, because the combustion chamber 3*b* is provided at a downstream side of the mixing chamber 3*i*, combustion flames and non-combustion mixed gas in the mixing chamber 3*i* are introduced into the combustion chamber 3*b* from the communication holes 3*h* of the partition plate 3*f*. Further, air divided into the air passage 3*f* is also introduced into the combustion chamber 3*b* from the air introduction port 3*c*. Thus, in the combustion chamber 3*b*, the combustion flames and non-combustion mixed gas from the mixing chamber 3*i* are completely burned with the supplied air from the air passage 3*f*.

Air to be introduced into the combustion chamber 3*b* from the air introduction port 3*c* passes through the air passage 3*f* adjacent to the mixing chamber 3*i* and is heated by heat radiated from the mixing chamber. Therefore, the temperature of the combustion chamber 3*b* is prevented from being reduced with the air introduction from the air introduction port 3*c*. Thus, consumption effect of the consumption device is improved. Further, because air is introduced from the air introduction port 3*c* to be crossed with the axial line of the combustion chamber 3*b*, the non-combustion mixed gas from the mixing chamber 3*i* is disturbed by the air introduction from the air introduction port 3*c*, and the atomization of fuel in the mixed gas is facilitated.

As described above, in the above-described embodiment, since the mixing chamber 3*i* is disposed at an upstream side of the combustion chamber 3*b*, the mixing space is used as preliminary mixing and combustion of the injection fuel. Therefore, combustion performance of mixed air is improved in the combustion chamber 3*b*, and it is unnecessary to set the size of the combustion chamber 3*b* to be larger.

Further, because the mixing chamber 3*i* of the combustion receiver 3 has a vertical sectional shape where the width dimension is gradually increased toward the combustion chamber 3*b*, mixed gas in the mixing chamber 3*i* smoothly extends, and mixing performance of the mixed gas is improved.

According to fifth embodiment of the present invention, the electrode portion (ignition portion) of the ignition plug 30 is disposed inside or outside of the predetermined injection angle of the injection fuel from the fuel injection valve 4. That is, the electrode portion of the ignition plug 30 is set except for a position where a main flow of injection fuel reaches. Therefore, the electrode portion of the ignition plug 30 is not exposed in the main flow of injection fuel, but is exposed in atomized fuel scattering from the main flow. Thus, in the fifth embodiment, the ignition is readily performed by the atomized fuel. However, when the electrode portion of the ignition plug is exposed in the main flow of the ignition fuel, the fuel ignition is difficult due to liquid drops of injection fuel.

Further, according to the fifth embodiment of the present invention, because the air flowing hole 9*e* through which air flows is provided to be inclined by the predetermined angle, air is introduced into the mixing chamber 3*i* with the revolution. Therefore, the mixing performance between injection fuel and air is further improved by the revolution of air in the mixing chamber 3*i*.

According to the fifth embodiment, the porous member 3*e* is disposed on the partition plate 3*g* at the side of the mixing chamber 3*i* so that a part of liquid fuel without being evaporated is temporarily adsorbed. The adsorbed liquid fuel in the porous member 3*e* is evaporated by heat generated from the flames in the combustion chamber 3*b* and heat generated from the flames in the mixing chamber 3*e*. Thus, during the normal combustion after the supply of electrical power into the ignition plug 30 is stopped, fuel adsorbed in the porous member 3*e* is evaporated to burn in the mixing chamber 3*i* or in the combustion chamber 3*b*.

Figure 22:
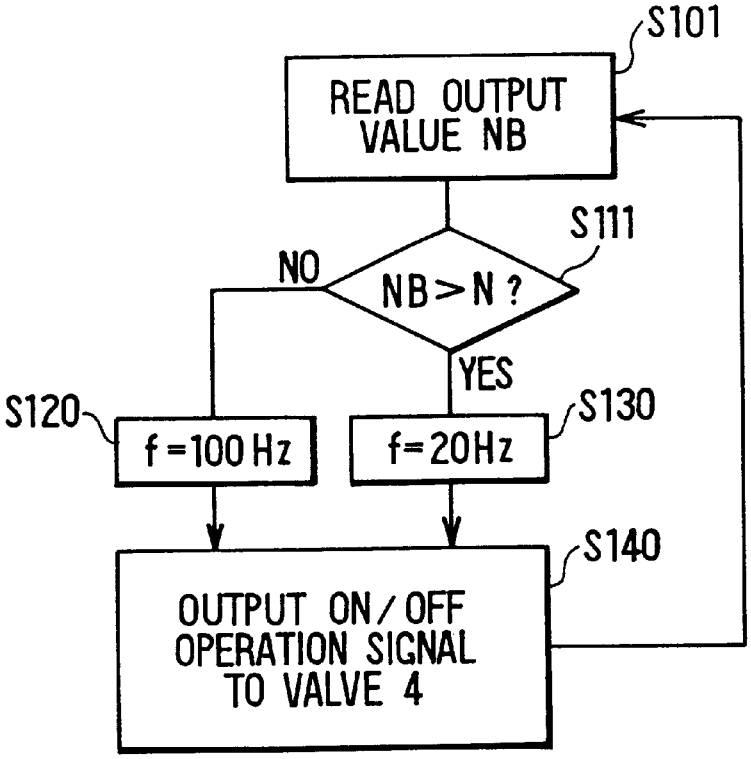
FIG. 22 is a flow diagram showing a control operation of a combustion control unit of a combustion device according to a sixth preferred embodiment of the present invention.

A sixth preferred embodiment of the present invention will be now described with reference to FIG. 22. In the sixth embodiment, the structure of a combustion device is similar to that in the above-described fifth embodiment. In the sixth embodiment, instead of the oxygen sensor 110 described in the fifth embodiment, a temperature sensor 111 is used as shown in FIG. 16. The temperature sensor 111 is a thermocouple sensor. As shown by the flow diagram in FIG. 22, at step S101, an output valve NB from the temperature sensor 111 is read into the combustion control unit 32. Next, in the determination part of the combustion control unit 32, it is determined whether or not the output valve NB from the temperature sensor 111 is larger than a predetermined value N. At the combustion initial time, because the combustion temperature within the combustion chamber 3*b* is low, the output value NB from the temperature sensor 111 is lower than the predetermined value N. Thus, at step S111, when the output value NB is not larger than the predetermined value N, the combustion control unit 32 controls the electromagnetic coil 26 of the fuel injection valve 4 so that the needle value 25 of the fuel injection valve 4 is vibrated with the frequency of 100 Hz. Therefore, fuel injected from the fuel injection valve 4 is atomized. Further, at step S140, an on/off operation signal is output from the combustion control unit 32 to the electromagnetic coil 26 of the fuel injection valve 4.

On the other hand, when the mixing performance between the injection fuel and combustion air is improved and the combustion becomes in the normal state, the temperature within the combustion chamber 3*b* increases. Therefore, the output value NB from the temperature sensor 111 becomes larger than the predetermined value N at step S111. Therefore, at step S130, the combustion control unit 32 controls the electromagnetic coil 26 so that the needle valve 25 of the fuel injection valve 4 is vibrated with the frequency of 20 Hz. Further, in the sixth embodiment, the combustion device has the fuel collision portion 9 similar to that in the fifth embodiment. Thus, in the sixth embodiment, the operation effect similar to that in the above-described fifth embodiment is obtained.

Figure 23:
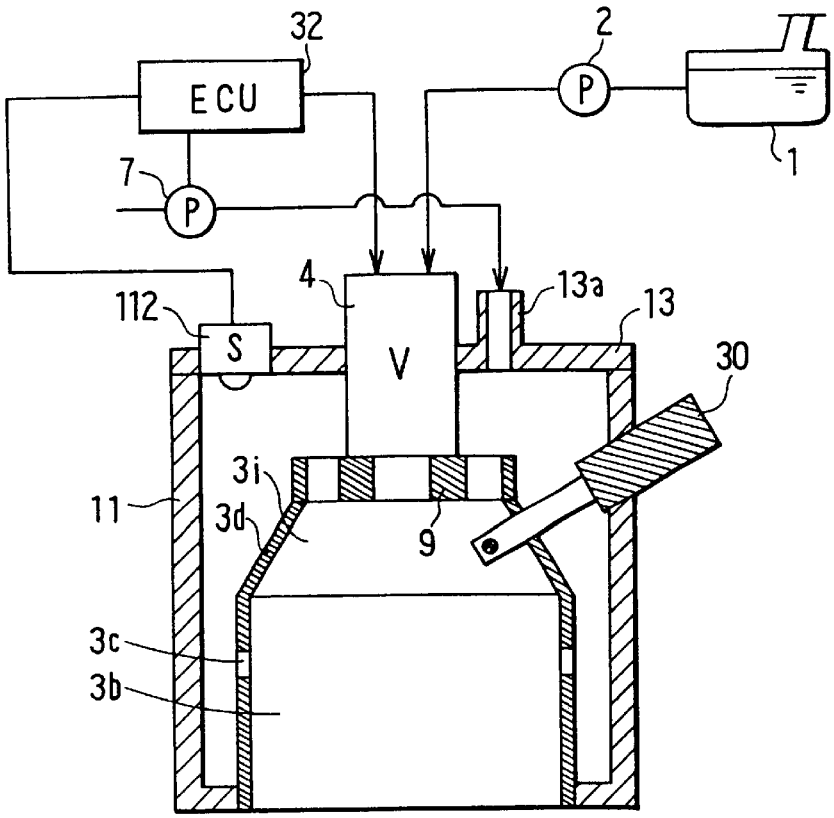
FIG. 23 is a partially vertical sectional view showing a combustion device according to a seventh preferred embodiment of the present invention.

A seventh preferred embodiment of the present invention will be now described with reference to FIGS. 23 and 24. In the seventh embodiment, a luminous intensity due to combustion flames within the combustion chamber 3*b* is detected by a luminous intensity sensor 112, and the fuel injection frequency of the fuel injection valve 4 is controlled based on an output value NC from the luminous intensity sensor 112. In the luminous intensity sensor 112, electric current value is changed in accordance with the luminous intensity. The luminous intensity sensor 112 is fixed to the flange 13 of the housing 11. The luminous intensity sensor 112 detects a luminous intensity of combustion flames in the combustion chamber 3*b*, leaked from the air introduction port 3*c* of the combustion receiver 3.

Figure 24:
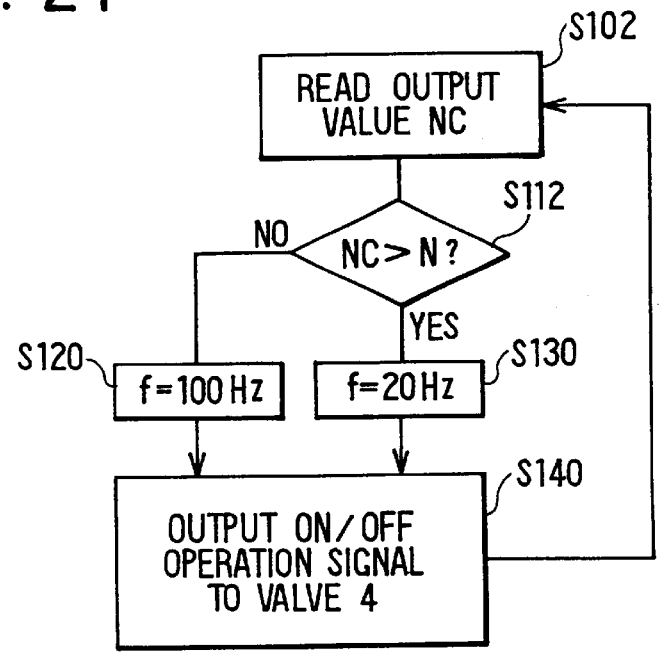
FIG. 24 is a flow diagram showing a control operation of a combustion control unit of the combustion device according to the seventh embodiment.

As shown by the flow diagram in FIG. 24, at step S102, the output valve NC from the luminous intensity sensor 112 is read into the combustion control unit 32. Next, at step S112, in the determination part of the combustion control unit 32, it is determined whether or not the output valve (electrical current) NC from the luminous intensity sensor 112 is larger than a predetermined value N. When the output value NC is not larger than the predetermined value N, the combustion control unit 32 controls the electromagnetic coil 26 of the fuel injection valve 4 so that the needle valve 25 of the fuel injection valve 4 is vibrated with the frequency of 100 Hz. Therefore, fuel injected from the fuel injection valve 4 is atomized. Further, at step S140, an on/off operation signal is output from the combustion control unit 32 to the electromagnetic coil 26 of the fuel injection valve 4.

On the other hand, when the combustion within the combustion chamber 3*b* becomes in the normal state, the temperature within the combustion chamber 3*b* increases. Therefore, the output value (i.e., current value) NC from the luminous intensity sensor 112 becomes larger than the predetermined value N at step S112. Therefore, at step S130, the combustion control unit 32 controls the electromagnetic coil 26 so that the needle valve 25 of the fuel injection valve 4 is vibrated with the frequency of 20 Hz.

Further, in the seventh embodiment, the combustion device has the fuel collision portion 9 similar to that in the fifth embodiment. Thus, in the seventh embodiment, the operation effect similar to that in the above-described fifth embodiment is obtained.

Figure 25:
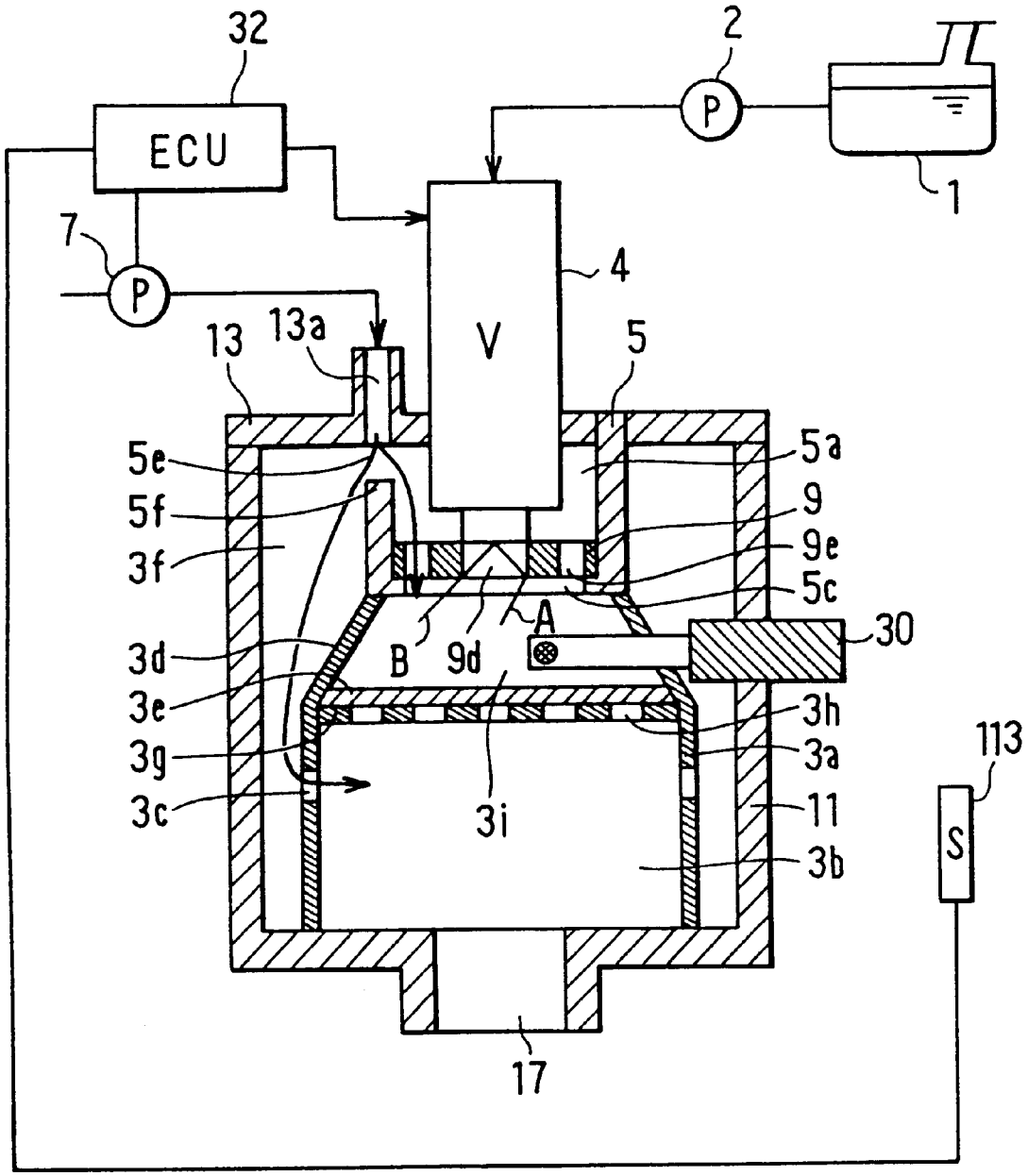
FIG. 25 is a partially vertical sectional view showing a combustion device according to an eighth preferred embodiment of the present invention.

An eighth preferred embodiment of the present invention will be now described with reference to FIG. 25. In the eighth embodiment, an outside peripheral temperature outside the combustion chamber 3*b* is detected by an outside temperature sensor 113, and the fuel injection frequency of the fuel injection valve 4 is controlled based on an output value from the temperature sensor 113. In the eighth embodiment, the temperature sensor 113 is a thermistor. Similarly to the flow diagram in FIG. 22, an output valve (temperature) from the temperature sensor 113 is read into the combustion control unit 32. Next, in the determination part of the combustion control unit 32, it is determined whether or not the temperature detected by the temperature sensor 113 is higher than a predetermined temperature. When the temperature from the temperature sensor 113 is not higher than the predetermined temperature, the combustion control unit 32 controls the electromagnetic coil 26 of the fuel injection valve 4 so that the needle valve 25 of the fuel injection valve 4 is vibrated with the frequency of 100 Hz. Therefore, fuel injected from the fuel injection valve 4 is atomized.

On the other hand, when the combustion within the combustion chamber 3*b* becomes in the normal state, the temperature within the combustion chamber 3*b* increases. Therefore, the temperature (i.e., current value) detected by the temperature sensor 113 becomes higher than the predetermined value. Therefore, the combustion control unit 32 controls the electromagnetic coil 26 so that the needle valve 25 of the fuel injection valve 4 is vibrated with the frequency of 20 Hz.

Further, in the eighth embodiment, the combustion device has the fuel collision portion 9 similar to that in the above-described fifth embodiment. Thus, in the eighth embodiment, the operation effect similar to that in the above-described fifth embodiment is obtained.

Figure 26:
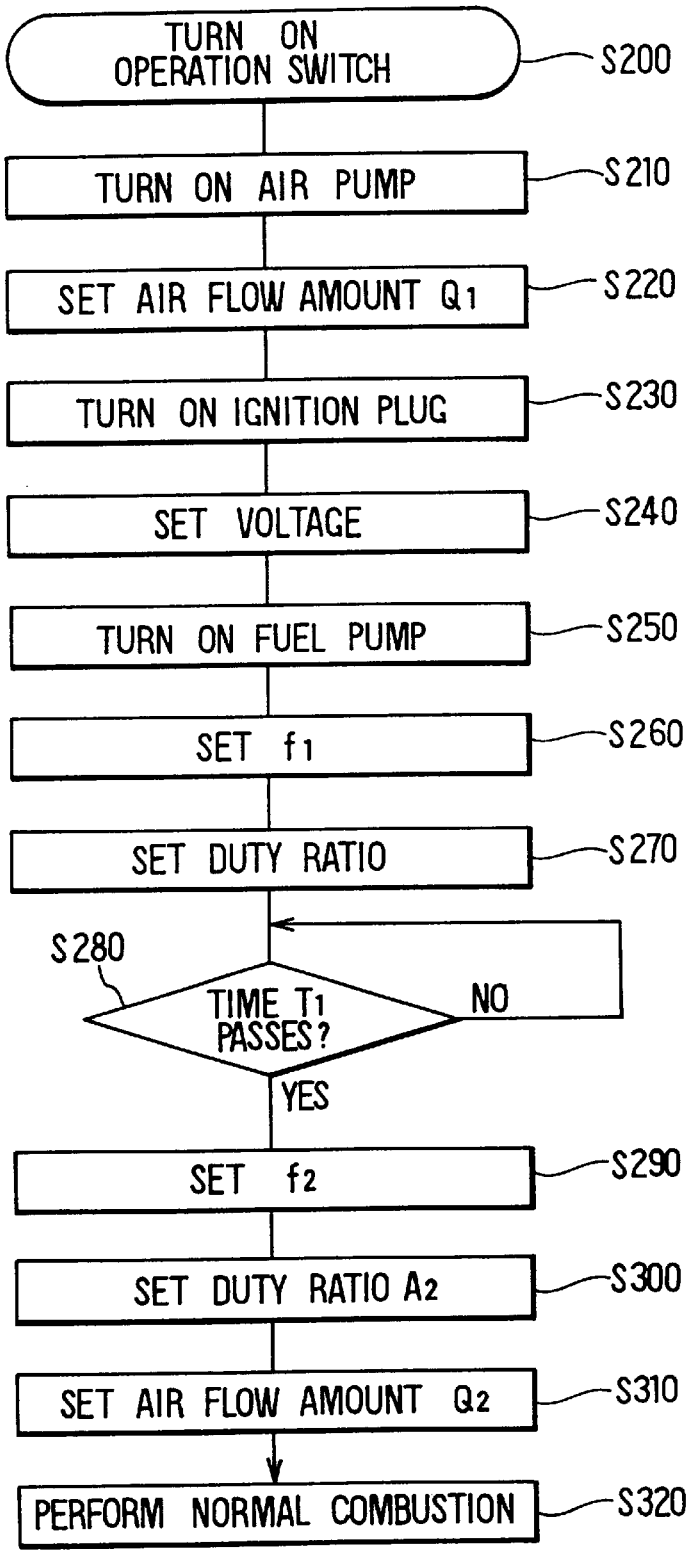
FIG. 26 is a flow diagram showing a control operation of a combustion control unit of a combustion device according to a ninth preferred embodiment of the present invention.
Figure 27:
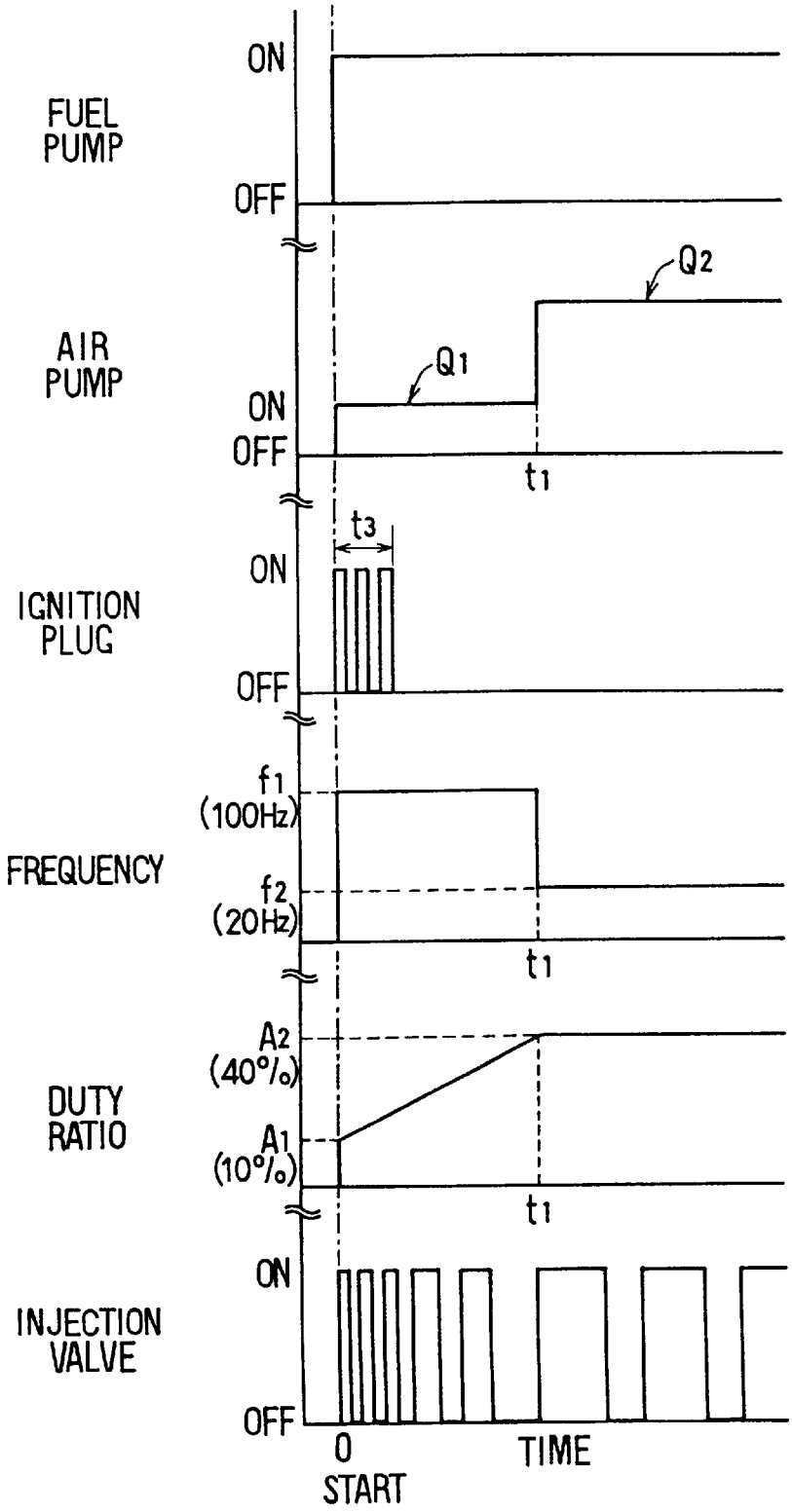
FIG. 27 is graphs showing time operations of a fuel pump, an air pump, an ignition plug, a fuel injection frequency of a fuel injection valve, a duty ratio of the fuel injection valve and an opening/closing of the fuel injection valve, after a combustion operation switch is turned on, according to the ninth embodiment.

A ninth preferred embodiment of the present invention will be now described with reference to FIGS. 26, 27. In the ninth embodiment, the fuel injection frequency of the fuel injection valve is controlled without using a sensor of the above-described fifth through eighth embodiments. In the ninth embodiment, the structure of a combustion device is similar to that described in FIG. 16. However, the oxygen sensor 110 in FIG. 16 is not provided. As shown by the flow diagram in FIG. 26, when the combustion operation switch 33*a* (FIG. 4) is turned on at step S200, the air pump 7 is turned on at step S210, and the air pump 7 operates with the flow amount Q1 in FIG. 27 at step S220. Next, the ignition plug 30 operates at step S230, and a predetermined voltage applied to the ignition plug 30 is set at step S240. Further, the fuel pump 2 is turned on at step S250, and the operation of the fuel pump 2 is controlled as described in the fifth embodiment. Further, during the predetermined time t1 after the combustion operation switch 33*a* is turned on, the fuel injection valve 4 operates with the frequency f1 of 100 Hz at step S260. After the predetermined time t1 passes, the fuel injection valve 4 operates with the frequency f2 of 20 Hz. The frequency switch is performed by a timer unit of the combustion control unit 32. Further, at step S270, the fuel injection duty ratio is set. After the combustion operation starts, the duty ratio is increased from A1. Next, at step S280, it is determined whether or not the predetermined operation time t1 passes. When the predetermined time t1 passes at step S280, the fuel injection valve 4 operates with the frequency f2 of 20 Hz at step S290, the duty ratio is set to A2 at step S300, and the air flow amount is set to Q2 at step S310. Thus, at step S320, the normal combustion operation is performed. According to the ninth embodiment, the switch of the fuel injection frequency of the fuel injection valve 4 is performed without providing a sensor described in the above described fifth through eighth embodiments.

Further, in the ninth embodiment, the combustion device has the fuel collision portion 9 similar to that in the fifth embodiment. Thus, in the ninth embodiment, the operation effect similar to that in the above-described fifth embodiment is obtained.

Although the present invention has been fully described in connection with the preferred embodiments thereof with reference to the accompanying drawings, it is to be noted that various changes and modifications will become apparent to those skilled in the art.

In the above-described first embodiment, fuel collides with the edge portion 9*f* of the fuel flowing hole 9*d* of the collision member 9. However, the collision member 9 is set so that fuel collides with the inner wall defining the fuel flowing hole 9*d*, connected to the edge portion 9*f*.

In the above described second embodiment, as the fuel-collision switching means for switching the collision operation and the non-collision operation of injection fuel based on the temperature within the combustion chamber 3*b*, the thermal expansion coefficient of the leg portions 90 of the collision member 9 are set to be higher than that of cylindrical portion 5 having the flange portion 5C. However, in a combustion device having a temperature sensor for detecting temperature within the combustion chamber 3*b* and an actuator for adjusting a position of the fuel collision member 9 based on the signal from the temperature sensor, the fuel-collision switching means may be constructed by electrical means such as the temperature sensor and the actuator. The fuel-collision switching means may be constructed by mechanical means using a material such as a bimetal or a shape-memory alloy. Alternatively, an actuator disposed in the fuel collision member 9 may be operated by using a duty signal difference into the electromagnetic coil 26 of the fuel injection valve 4, between during the ignition time and during the normal combustion operation.

Further, in the above-described second embodiment, the collision operation and the non-collision operation of injection fuel can be selectively set based on the temperature within the combustion chamber 3*b* or a relational temperature relative to the temperature within the combustion chamber 3*b*. Here, the relational temperature is a temperature outside the combustion chamber 3*b*, is a temperature within a passenger compartment when the combustion device is applied to a heating unit for heating the passenger compartment, or is a temperature of a vehicle component when the combustion device is applied to a heating unit for heating the vehicle component.

In the above-described fourth embodiment, the valve member 56 is moved in accordance with the pressure of air passing through the opening 51 of the valve portion 52 of the valve member 56. However, an actuator for adjusting the position of the valve member 56 in accordance with the pressure of air pumped from the air pump 7 may be provided, and the fuel-collision switching means may be constructed by the actuator driven by electrically.

The fuel collision member 9 having the protrusion 9*f* described in the fifth embodiment may be applied to the combustion device described in the first through fourth embodiments. In the above-described fifth embodiment, the ignition plug 30 is disposed in the mixing chamber 3*i*. However, the ignition plug 30 may be disposed in the combustion chamber 3*b*.

In each of the above-described embodiments, the ignition plug 30 is used as an ignition unit. However, a glow plug may be used as the ignition unit. Further, as the injection fuel, a liquid oil such as light oil, lamp oil, methanol and gasoline may be used.

Such changes and modifications are to be understood as being within the scope of the present invention as defined by the appended claims.

What is claimed is:

1. A combustion device comprising:

a combustion receiver for defining a combustion chamber;

a fuel injection unit having an injection port for injecting fuel to be introduced into said combustion chamber;

an air supplying unit for supplying air into said combustion chamber;

an ignition unit for igniting a mixed gas between fuel and air in said combustion chamber; and a fuel collision unit disposed between said injection port and said combustion chamber in such a manner that, a first part of fuel injected from said injection port of said fuel injection unit directly collides with said fuel collision unit, and a second part of fuel is directly introduced from said injection port to said combustion chamber; wherein:

said fuel collision unit includes a plate portion having a first surface on a fuel injection side of said fuel injection unit and a second surface on a side of said combustion chamber;

said plate portion has an inner wall defining a fuel opening through which fuel injected from said fuel injection unit passes; and said fuel injection unit and said fuel collision unit are disposed in such a manner that, when fuel injected from said injection port of said fuel injection unit passes through said fuel opening, a part of fuel is introduced into said combustion chamber while colliding with the inner wall and the other part of fuel is introduced into said combustion chamber through said fuel opening while being prevented from colliding with said inner wall.

2. The combustion device according to claim 1, wherein, said fuel injection unit and said fuel collision unit are disposed in such a manner that, when fuel injected from said injection port of said fuel injection unit passes through said fuel opening, a part of fuel is introduced into said combustion chamber while colliding with an edge portion between said inner wall and said second surface of said plate portion, and the other part of fuel is introduced into said combustion chamber through said fuel opening while being prevented from colliding with said edge portion.

3. The combustion device according to claim 1, further comprising means for defining an air passage through which air from said air supplying unit is introduced into said combustion chamber, wherein said air passage is provided around said fuel injection unit.

4. The combustion device according to claim 1, further comprising a detecting unit for detecting a combustion state of mixed gas between fuel from said fuel injection unit and air from said air supplying unit, within said combustion chamber; and a control unit for controlling an operation state of said fuel injection unit in accordance with the combustion state detected by said detecting unit.

5. The combustion device according to claim 4, wherein:

said fuel injection unit includes an electromagnetic valve for injecting liquid fuel having a pressure higher than a predetermined pressure; and said control unit controls a fuel injection frequency of said electromagnetic valve in accordance with the combustion state detected by said detecting unit.

6. The combustion device according to claim 5, wherein:

when the combustion state of said combustion chamber detected by said detecting unit is in a predetermined state, the fuel injection frequency of said electromagnetic valve is set to be higher than a predetermined value; and when the combustion state of said combustion chamber detected by said detecting unit is in a state except for the predetermined state, the fuel injection frequency of said electromagnetic valve is set to be lower than the predetermined value.

7. The combustion device according to claim 6, wherein:

said detecting unit is one of an oxygen sensor for detecting an oxygen density in the combustion state of said combustion chamber, a temperature sensor for detecting a combustion temperature in the combustion state of said combustion chamber, and a luminous intensity sensor for detecting a luminous intensity in the combustion state of said combustion chamber;

when the detecting unit is said oxygen sensor, the fuel injection frequency is set to be higher than the predetermined value when the oxygen density detected by said oxygen sensor is higher than a predetermined density;

when the detecting unit is said temperature sensor, the fuel injection frequency is set to be higher than the predetermined value when the temperature detected by said temperature sensor is lower than a predetermined temperature; and when the detecting unit is said luminous intensity sensor, the fuel injection frequency is set to be higher than the predetermined value when the luminous intensity detected by said luminous intensity sensor is higher than a predetermined intensity.

8. The combustion device according to claim 1, further comprising:

a detecting unit for detecting an atmosphere temperature outside said combustion chamber; and a control unit for controlling an operation state of said fuel injection unit in accordance with the atmosphere temperature detected by said detecting unit, wherein:

said fuel injection unit includes an electromagnetic valve for injecting liquid fuel having a pressure higher than a predetermined pressure; and said control unit controls a fuel injection frequency of said electromagnetic valve to be higher than a predetermined value when the atmosphere temperature detected by said detecting unit is lower than a predetermined temperature.

9. The combustion device according to claim 1, wherein:

said fuel injection unit includes an electromagnetic valve for injecting liquid fuel having a pressure higher than a predetermined pressure;

said fuel injection unit is disposed so that fuel is injected from said injection port at a predetermined injection angle;

said ignition unit has an ignition portion for generating an ignition; and said ignition portion is positioned inside or outside said predetermined injection angle of fuel injected from said injection port.

10. The combustion device according to claim 1, further comprising a partition member for partitioning said combustion chamber into an air mixing space on a side of said injection port and a combustion space provided downstream from said mixing space to communicate with said mixing space;

said air supplying unit is disposed to directly supply air into both said combustion space and said mixing space;

an air amount supplying into said mixing space is set so that fuel becomes in a rich state in the mixed gas; and said ignition unit is disposed in, said mixing space.

11. The combustion device according to claim 10, wherein:

said combustion receiver has a wall portion for defining said mixing space; and said wall portion has a vertical sectional shape where a width dimension is gradually increased toward said combustion space downstream from said mixing space.

12. The combustion device according to claim 10, further comprising means for forming an air supplying passage around a first wall portion for defining said mixing space and a second wall portion for defining said combustion space;

said air supplying unit is disposed to introduce air from said air supplying unit into said air supplying passage; and said second wall portion has an opening through which air is directly introduced from said air supplying passage into said combustion space.

13. The combustion device according to claim 10, wherein said partition member has an opening through which said mixing space and said combustion space communicate with each other.

14. The combustion device according to claim 13, further comprising a porous member for temporarily receiving liquid fuel and for evaporating the liquid fuel, wherein said porous member is disposed on said partition member on a side of said mixing space.

15. The combustion device according to claim 1, further comprising a control unit for controlling an operation state of said fuel injection unit, wherein:

said fuel injection unit has an electromagnetic valve for injecting liquid fuel having a pressure higher than a predetermined pressure;

said control unit controls a fuel injection frequency of said fuel injection unit to be higher than a predetermined value until a predetermined time passes after operation of said fuel injection unit starts; and said control unit controls the fuel injection frequency of said fuel injection unit to be lower than the predetermined value after the predetermined time passes.

16. The combustion device according to claim 1, wherein:

said plate portion has a protrusion protruding from said inner wall defining said fuel opening; and said protrusion is provided so that a part of fuel injected from said fuel injection unit collides with only said protrusion.

17. A combustion device comprising:

a combustion receiver for defining a combustion chamber;

a fuel injection unit having an injection port for injecting fuel to be introduced into said combustion chamber;

an air supplying unit for supplying air into said combustion chamber;

an ignition unit for igniting a mixed gas between fuel and air in said combustion chamber; and a fuel collision unit disposed between said injection port and said combustion chamber in such a manner that, a first part of fuel injected from said injection port of said fuel injection unit directly collides with said fuel collision unit, and a second part of fuel is directly introduced from said injection port to said combustion chamber; wherein:

said fuel collision unit includes a plate portion having a first surface on a fuel injection side of said fuel injection unit and a second surface on a side of said combustion chamber, said plate portion has an inner wall defining a fuel opening through which fuel injected from said fuel injection unit passes, and a protrusion protruding from said inner wall; and said fuel injection unit and said fuel collision unit are disposed in such a manner that, when fuel injected from said injection port of said fuel injection unit passes through said fuel opening, a part of fuel is introduced into said combustion chamber while colliding with said protrusion of said inner wall, and the other part of fuel is introduced into said combustion chamber through said fuel opening while being prevented from colliding with said inner wall and said protrusion.

18. A combustion device comprising:

a combustion receiver for defining a combustion chamber;

a fuel injection unit having an injection port for injecting fuel to be introduced into said combustion chamber;

an air supplying unit for supplying air into said combustion chamber;

an ignition unit for igniting a mixed gas between fuel and air in said combustion chamber;

a fuel-collision switching unit having a fuel collision member disposed between said injection port and said combustion chamber; and a control unit for controlling said fuel-collision switching unit to selectively set a collision mode where fuel injected from said fuel injection unit is introduced into said combustion chamber while colliding with said collision member, and a non-collision mode where fuel injected from said fuel injection unit is introduced into said combustion chamber without colliding with said collision member, in accordance with a temperature within said combustion chamber or a relational temperature relative to the temperature within said combustion chamber.

19. The combustion device according to claim 18, wherein:

said control unit controls said fuel-collision switching unit to set said collision mode when the temperature of said combustion chamber is a normal temperature; and said control unit controls said fuel-collision switching unit to set said non-collision mode when the temperature of said combustion chamber is higher than the normal temperature by a predetermined temperature.

20. The combustion device according to claim 19, wherein:

said fuel-collision switching unit further includes a supporting member for supporting said collision member; and said collision member has a thermal expansion coefficient set to be relatively larger than that of said supporting member so that, a relative position between said collision member and said injection port of said fuel injection unit is changed due to a thermal expansion of said collision member in accordance with a variation in temperature within said combustion chamber, fuel injected from said injection port is prevented from colliding with said collision member when said collision member is positioned close to said injection port, and fuel injected from said injection port collides with said collision member when said collision member is positioned away from said injection port.

21. The combustion device according to claim 19, wherein:

said fuel-collision switching unit further includes a supporting member for supporting said collision member, and a stand member between said collision member and said supporting member; and said stand member has a thermal expansion coefficient set to be relatively larger than that of said supporting member and said collision member so that, a relative position between said collision member and said injection port of said fuel injection unit is changed due to a thermal expansion of said stand member in accordance with a variation in temperature within said combustion chamber, fuel injected from said injection port is prevented from colliding with said collision member when said collision member is positioned close to said injection port, and fuel injected from said injection port collides with said collision member when said collision member is positioned away from said injection port.

22. The combustion device according to claim 18, further comprising means for defining an air passage through which air from said air supplying unit is introduced into said combustion chamber, wherein said air passage is provided around said fuel injection unit.

23. The combustion device according to claim 18, further comprising a detecting unit for detecting a combustion state of mixed gas between fuel from said fuel injection unit and air from said air supplying unit, within said combustion chamber, wherein:

said control unit controls an operation state of said fuel injection unit in accordance with the combustion state detected by said detecting unit;

said fuel injection unit includes an electromagnetic valve for injecting liquid fuel having a pressure higher than a predetermined pressure; and said control unit controls a fuel injection frequency of said electromagnetic valve in accordance with the combustion state detected by said detecting unit.

24. The combustion device according to claim 23, wherein:

when the combustion state of said combustion chamber detected by said detecting unit is in a predetermined state, the fuel injection frequency of said electromagnetic valve is set to be higher than a predetermined value; and when the combustion state of said combustion chamber detected by said detecting unit is in a state except for the predetermined state, the fuel injection frequency of said electromagnetic valve is set to be lower than the predetermined value.

25. The combustion device according to claim 18, further comprising:

a detecting unit for detecting an atmosphere temperature outside said combustion chamber, wherein:

said control unit controls an operation state of said fuel injection unit in accordance with the atmosphere temperature detected by said detecting unit;

said fuel injection unit includes an electromagnetic valve for injecting liquid fuel having a pressure higher than a predetermined pressure; and said control unit controls a fuel injection frequency of said electromagnetic valve to be higher than a predetermined value when the atmosphere temperature detected by said detecting unit is lower than a predetermined temperature.

26. The combustion device according to claim 18, wherein:

said fuel injection unit includes an electromagnetic valve for injecting liquid fuel having a pressure higher than a predetermined pressure;

said fuel injection unit is disposed so that fuel is injected from said injection port at a predetermined injection angle;

said ignition unit has an ignition portion for generating an ignition; and said ignition portion is positioned inside or outside said predetermined injection angle of fuel injected from said injection port.

27. The combustion device according to claim 18, further comprising a partition member for partitioning said combustion chamber into an air mixing space on a side of said injection port and a combustion space provided downstream from said mixing space to communicate with said mixing space;

said air supplying unit is disposed to directly supply air into both said combustion space and said mixing space;

an air amount supplying into said mixing space is set so that fuel becomes in a rich state in the mixed gas; and said ignition unit is disposed in said mixing space.

28. The combustion device according to claim 27, further comprising means for forming an air supplying passage around a first wall portion for defining said mixing space and a second wall portion for defining said combustion space;

said air supplying unit is disposed to introduce air from said air supplying unit into said air supplying passage; and said second wall portion has an opening through which air is directly introduced from said air supplying passage into said combustion space.

29. The combustion device according to claim 27, further comprising a porous member for temporarily receiving liquid fuel and for evaporating the liquid fuel, wherein said porous member is disposed on said partition member on a side of said mixing space.

30. The combustion device according to claim 18, wherein:

said fuel injection unit has an electromagnetic valve for injecting liquid fuel having a pressure higher than a predetermined pressure;

said control unit controls a fuel injection frequency of said fuel injection unit to be higher than a predetermined value until a predetermined time passes after operation of said fuel injection unit starts; and said control unit controls the fuel injection frequency of said fuel injection unit to be lower than the predetermined value after the predetermined time passes.

31. A combustion device comprising:

a combustion receiver for defining a combustion chamber;

a fuel injection unit having an injection port for injecting fuel to be introduced into said combustion chamber;

an air supplying unit for supplying air into said combustion chamber;

an ignition unit for igniting a mixed gas between fuel and air in said combustion chamber;

a fuel-collision switching unit having a fuel collision member disposed between said injection port and said combustion chamber; and a control unit for controlling said fuel-collision switching unit to selectively set a collision mode where fuel injected from said fuel injection unit is introduced into said combustion chamber while colliding with said collision member, and a non-collision mode where fuel injected from said fuel injection unit is introduced into said combustion chamber without colliding with said collision member, in accordance with pressure of air from said air supplying unit.

32. The combustion device according to claim 31, wherein:

said control unit controls said fuel-collision switching unit to set said collision mode when the pressure of air from said air supplying unit is lower than a predetermined pressure; and said control unit controls said fuel-collision switching unit to set said non-collision mode when the pressure of air from said air supplying unit is higher than the predetermined pressure.

33. The combustion device according to claim 32, wherein:

said fuel-collision switching unit further includes a valve member having a first wall portion used as said fuel collision member for defining a fuel opening through which fuel from said injection port passes and a second wall portion for defining an air opening through which air from said air supplying unit passes;

said valve member is movable relative to said fuel injection unit in accordance with a variation in the pressure of air passing through said air opening;

said valve member is set so that a relative position between said collision member and said injection port of said fuel injection unit is changed by the variation in the pressure of air passing through said air opening;

said valve member is operated so that fuel injected from said injection port is introduced into said combustion chamber while being prevented from colliding with said collision member, when the pressure of air passing through said air opening is higher than the predetermined pressure; and said valve member is operated so that fuel injected from said injection port is introduced into said combustion chamber while colliding with said collision member, when the pressure of air passing through said air opening is lower than the predetermined pressure.

34. The combustion device according to claim 33, wherein:

said valve member includes a valve portion at a fuel injection side of said fuel injection unit, a supporting portion for supporting said valve portion, and a spring portion disposed between said valve portion and said fuel injection side of said fuel injection unit for pressing said valve portion toward said supporting portion;

said valve portion has said fuel opening through which fuel injected from said injection port of said fuel injection unit passes, and said air opening through which air from said air supplying unit passes;

said supporting portion has an opening communicating with said fuel opening and said air opening;

said valve portion is operated away from said supporting portion toward said fuel injection unit while opposing to a pressing force of said spring portion so that fuel injected from said injection port is introduced into said combustion chamber while being prevented from colliding with said collision member, when the pressure of air passing through said air opening is higher than the predetermined pressure; and said valve portion is operated close to said supporting portion to be away from said fuel injection unit by the pressure force of said spring portion so that fuel injected from said injection port is introduced into said combustion chamber while colliding with said collision member, when the pressure of air passing through said air opening is lower than the predetermined pressure.

35. The combustion device according to claim 31, further comprising a detecting unit for detecting a combustion state of mixed gas between fuel from said fuel injection unit and air from said air supplying unit, within said combustion chamber, wherein:

said control unit controls an operation state of said fuel injection unit in accordance with the combustion state detected by said detecting unit;

said fuel injection unit includes an electromagnetic valve for injecting liquid fuel having a pressure higher than a predetermined pressure; and said control unit controls a fuel injection frequency of said electromagnetic valve in accordance with the combustion state detected by said detecting unit.

36. The combustion device according to claim 31, further comprising:

a detecting unit for detecting an atmosphere temperature outside said combustion chamber, wherein:

said control unit controls an operation state of said fuel injection unit in accordance with the atmosphere temperature detected by said detecting unit;

said fuel injection unit includes an electromagnetic valve for injecting liquid fuel having a pressure higher than a predetermined pressure; and said control unit controls a fuel injection frequency of said electromagnetic valve to be higher than a predetermined value when the atmosphere temperature detected by said detecting unit is lower than a predetermined temperature.

37. The combustion device according to claim 31, wherein:

said fuel injection unit includes an electromagnetic valve for injecting liquid fuel having a pressure higher than a predetermined pressure;

said fuel injection unit is disposed so that fuel is injected from said injection port at a predetermined injection angle;

said ignition unit has an ignition portion for generating an ignition; and said ignition portion is positioned inside or outside said predetermined injection angle of fuel injected from said injection port.

38. The combustion device according to claim 31, further comprising a partition member for partitioning said combustion chamber into an air mixing space on a side of said injection port and a combustion space provided downstream from said mixing space to communicate with said mixing space;

said air supplying unit is disposed to directly supply air into both said combustion space and said mixing space;

an air amount supplying into said mixing space is set so that fuel becomes in a rich state in the mixed gas; and said ignition unit is disposed in said mixing space.

39. The combustion device according to claim 38, further comprising means for forming an air supplying passage around a first wall portion for defining said mixing space and a second wall portion for defining said combustion space;

said air supplying unit is disposed to introduce air from said air supplying unit into said air supplying passage; and said second wall portion has an opening through which air is directly introduced from said air supplying passage into said combustion space.

40. The combustion device according to claim 31, wherein:

said fuel injection unit has an electromagnetic valve for injecting liquid fuel having a pressure higher than a predetermined pressure;

said control unit controls a fuel injection frequency of said fuel injection unit to be higher than a predetermined value until a predetermined time passes after operation of said fuel injection unit starts; and said control unit controls the fuel injection frequency of said fuel injection unit to be lower than the predetermined value after the predetermined time passes.

41. A combustion device comprising:

a combustion receiver for defining a combustion chamber;

a fuel injection unit having an injection port for injecting fuel to be introduced into said combustion chamber;

an air supplying unit for supplying air into said combustion chamber;

an ignition unit for igniting a mixed gas between fuel and air in said combustion chamber; and a fuel collision unit disposed between said injection port and said combustion chamber in such a manner that, a first part of fuel injected from said injection port of said fuel injection unit directly collides with said fuel collision unit, and a second part of fuel is directly introduced from said injection port to said combustion chamber; wherein:

said fuel collision unit includes a collision plate member having therein a fuel opening at an approximate center, through which fuel injected from said fuel injection unit passes, and a protrusion protruding from a wall surface of said collision plate member, defining said fuel opening; and said protrusion is provided in said wall surface so that a part of fuel injected from said fuel injection unit collides only with said protrusion.

* * * * *